US010635033B2

(12) United States Patent
Tsuchihashi et al.

(10) Patent No.: US 10,635,033 B2
(45) Date of Patent: Apr. 28, 2020

(54) IMAGE HEATING APPARATUS

(71) Applicant: CANON KABUSHIKI KAISHA, Tokyo (JP)

(72) Inventors: Naoto Tsuchihashi, Yokohama (JP); Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/411,795

(22) Filed: May 14, 2019

(65) Prior Publication Data

US 2019/0354048 A1 Nov. 21, 2019

(30) Foreign Application Priority Data

May 18, 2018 (JP) ..... 2018-096655
Apr. 15, 2019 (JP) ..... 2019-077218

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/2064* (2013.01); *G03G 15/5004* (2013.01); *G03G 2215/2035* (2013.01)

(58) Field of Classification Search
CPC ..... G03G 15/2039; G03G 15/2053; G03G 15/2064; G03G 15/5004; G03G 2215/2035
See application file for complete search history.

(56) References Cited

U.S. PATENT DOCUMENTS

| | | | |
|---|---|---|---|
| 6,701,107 | B2 | 3/2004 | Karakama et al. |
| 7,193,181 | B2 | 3/2007 | Makihara et al. |
| 7,283,145 | B2 | 10/2007 | Kato et al. |
| 7,599,637 | B2 | 10/2009 | Nanataki et al. |
| 7,865,102 | B2 | 1/2011 | Nanataki et al. |
| 8,433,212 | B2 | 4/2013 | Ono |
| 8,942,589 | B2 | 1/2015 | Asami et al. |
| 9,069,302 | B2 | 6/2015 | Samei et al. |
| 9,091,974 | B2 | 7/2015 | Yoshioka et al. |
| 9,122,212 | B2 | 9/2015 | Fujimoto et al. |
| 9,304,454 | B2 | 4/2016 | Suganuma et al. |
| 9,335,679 | B2 | 5/2016 | Tanaka et al. |
| 9,335,709 | B2 | 5/2016 | Iwasaki et al. |
| 9,377,727 | B2 | 6/2016 | Yoshioka et al. |
| 9,389,553 | B2 | 7/2016 | Yamamoto et al. |
| 9,568,867 | B2 | 2/2017 | Yoshioka et al. |

(Continued)

FOREIGN PATENT DOCUMENTS

| | | |
|---|---|---|
| JP | H04-274473 A | 9/1992 |
| JP | H06-095540 A | 4/1994 |

(Continued)

OTHER PUBLICATIONS

Extended European Search Report, dated Nov. 29, 2017, issued in European Patent Application No. 17178952.2.

*Primary Examiner* — David M. Gray
*Assistant Examiner* — Michael A Harrison
(74) *Attorney, Agent, or Firm* — Venable LLP

(57) ABSTRACT

In an image heating apparatus for heating an image formed on a recording material, a target temperature of heat generating elements corresponding to regions without an image when a recording material passes a nip portion is set in accordance with a length of the regions without an image in a longitudinal direction of a heater.

8 Claims, 14 Drawing Sheets

(56) References Cited

U.S. PATENT DOCUMENTS

| | | | | |
|---|---|---|---|---|
| 9,599,941 | B2 | 3/2017 | Yamaguchi et al. | |
| 9,665,048 | B2 | 5/2017 | Iwasaki et al. | |
| 9,989,900 | B2 | 6/2018 | Yoshioka et al. | |
| 10,054,882 | B2 | 8/2018 | Nomura et al. | |
| 10,114,318 | B2 | 10/2018 | Sako et al. | |
| 10,185,258 | B2 | 1/2019 | Sako et al. | |
| 10,228,641 | B2 | 3/2019 | Takagi | |
| 10,254,689 | B2 | 4/2019 | Nomura et al. | |
| 10,268,144 | B2 | 4/2019 | Iwasaki | |
| 10,321,518 | B2 | 6/2019 | Mine et al. | |
| 10,338,505 | B2 | 7/2019 | Nomura et al. | |
| 2002/0118977 | A1 | 8/2002 | Hasegawa et al. | |
| 2010/0196039 | A1 | 8/2010 | Ono | |
| 2014/0027441 | A1 | 1/2014 | Mine et al. | |
| 2014/0219672 | A1 | 8/2014 | Samei et al. | |
| 2015/0050038 | A1 | 2/2015 | Suganuma et al. | |
| 2015/0168886 | A1 | 6/2015 | Tanaka et al. | |
| 2015/0286174 | A1* | 10/2015 | Yamamoto | G03G 15/2039 399/69 |
| 2015/0331372 | A1 | 11/2015 | Takagi | |
| 2017/0364006 | A1* | 12/2017 | Minemura | G03G 15/2053 |
| 2018/0004135 | A1 | 1/2018 | Sako et al. | |
| 2018/0004136 | A1 | 1/2018 | Iwasaki | |
| 2018/0032008 | A1 | 2/2018 | Sako et al. | |
| 2018/0267442 | A1 | 9/2018 | Yoshioka et al. | |
| 2018/0341202 | A1 | 11/2018 | Nomura et al. | |
| 2019/0049881 | A1 | 2/2019 | Sako et al. | |
| 2019/0107801 | A1 | 4/2019 | Sako et al. | |
| 2019/0227466 | A1 | 7/2019 | Nomura et al. | |

FOREIGN PATENT DOCUMENTS

| | | | |
|---|---|---|---|
| JP | 2007-271870 | A | 10/2007 |
| JP | 2013-041118 | A | 2/2013 |
| JP | 2013-156570 | A | 8/2013 |
| JP | 2014-153506 | A | 8/2014 |
| JP | 2014-153507 | A | 8/2014 |
| JP | 2014-178427 | A | 9/2014 |
| JP | 2014170212 | A | 9/2014 |
| JP | 2015-036771 | A | 2/2015 |
| JP | 2015-059992 | A | 3/2015 |
| JP | 2015-064548 | A | 4/2015 |
| JP | 2015-087566 | A | 5/2015 |
| JP | 2015-143814 | A | 8/2015 |
| JP | 2015-197653 | A | 11/2015 |
| JP | 2018-004945 | A | 1/2018 |

* cited by examiner

IMAGE HEATING APPARATUS

BACKGROUND OF THE INVENTION

Field of the Invention

The present invention relates to an image heating apparatus such as a fixing apparatus mounted to an image forming apparatus such as copier or a printer using an electrophotographic system or an electrostatic recording system, a gloss imparting apparatus which reheats a toner image fixed to a recording material in order to improve a gloss value of the toner image, or the like. The present invention also relates to a heating control method used to control the image heating apparatus.

Description of the Related Art

There is an image heating apparatus which includes a cylindrical film (also referred to as an endless belt), a heater that comes into contact with an inner surface of the film, and a pressure roller that comes into pressure contact with the film and forms a nip portion. While a rotational driving force is applied to the film by the rotating pressure roller, in order to retain rotatability of the film, a sliding frictional force between the heater and the film must be reduced. To this end, generally, grease to act as a lubricant is applied on a contact surface of the heater with the film. Due to its small heat capacity, the image heating apparatus has characteristically superior quick-start ability and power saving ability. However, in response to recent demands for greater power saving, a method of selectively heating an image portion formed on a recording material (Japanese Patent Application Laid-open No. 2014-153507) is proposed. In this method, a heated region divided in plurality in a direction perpendicular to a transport direction of the recording material (hereinafter, referred to as a longitudinal direction) is set, and a heat generating element which heats each heated region is provided in plurality in the longitudinal direction. In addition, based on image information of an image formed in each heated region, an image portion is selectively heated by a corresponding heat generating element. Furthermore, a method which adjusts heating conditions in accordance with image information to achieve power saving (Japanese Patent Application Laid-open No. 2007-271870) is also proposed.

When using the methods described in Japanese Patent Application Laid-open No. 2014-153507 and Japanese Patent Application Laid-open No. 2007-271870, the lower a temperature regulation setting of the heat generating element corresponding to a non-image portion, the higher the produced power saving effect.

Generally, viscosity of the grease applied to the contact surface with the film has temperature dependence. The higher the temperature, the lower the viscosity of the grease, thereby acting to reduce the sliding frictional force with the film. Therefore, when the temperature of the heat generating element corresponding to a non-image portion is low, the viscosity of the grease applied to a region corresponding to the non-image portion is higher than when the temperature of the heat generating element corresponding to the non-image portion is high. In this case, since the sliding frictional force with the film increases in the region corresponding to the non-image portion, a rotation torque of the film as a whole also increases. In other words, the lower the set target temperature of the heat generating element, the greater the rotation torque of the film and a, consequently, higher risk of causing a rotation failure of the film. For this reason, when using the methods described in Japanese Patent Application Laid-open No. 2014-153507 and Japanese Patent Application Laid-open No. 2007-271870, a target temperature of a heat generating element is set to a temperature at which a rotation failure of the film does not occur.

An object of the present invention is to provide an image heating apparatus that selectively heats an image portion as described above but with superior power saving ability.

SUMMARY OF THE INVENTION

To achieve the above object, an image heating apparatus for heating an image formed on a recording material, according to the present invention, includes:

a cylindrical film, wherein a lubricant is applied to an inner surface of the film;

a heater which is in contact with the inner surface of the film, the heater having a plurality of heat generating elements arranged in a longitudinal direction of the heater which is perpendicular to a transport direction of the recording material;

a roller which is in contact with an outer surface of the film and which forms a nip portion that sandwiches the recording material together with the film and that transports the recording material; and a control portion capable of individually controlling power supplied to the plurality of heat generating elements, wherein the apparatus heats an image formed on the recording material by heat of the heater while sandwiching and transporting the recording material using the nip portion, wherein the control portion supplies power to the plurality of heat generating elements so that regions without an image on the recording material are also heated during a period in which the recording material is heated in the nip portion, and wherein a target temperature of the heat generating elements corresponding to the regions without an image when the recording material passes the nip portion is set in accordance with a length of the regions without an image in the longitudinal direction of the heater.

To achieve the above object, an image heating apparatus for heating an image formed on a recording material, according to the present invention, includes:

a cylindrical film, wherein a lubricant is applied to an inner surface of the film;

a heater which is in contact with the inner surface of the film, the heater having a plurality of heat generating elements arranged in a longitudinal direction of the heater which is perpendicular to a transport direction of the recording material;

a roller which is in contact with an outer surface of the film and which forms a nip portion that sandwiches the recording material together with the film and that transports the recording material; and a control portion capable of individually controlling power to be supplied to the plurality of heat generating elements, wherein the apparatus heats an image formed on the recording material by heat of the heater while sandwiching and transporting the recording material using the nip portion, wherein the control portion supplies power to the plurality of heat generating elements so that regions where the recording material does not pass are also heated during a period in which the recording material is heated, and wherein a target temperature of the heat generating elements corresponding to the regions where the recording material does not pass when the recording material passes the nip portion is set in accordance with a length of the regions where the recording material does not pass in the longitudinal direction of the heater.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

1. Configuration of Image Forming Apparatus

Figure 1:
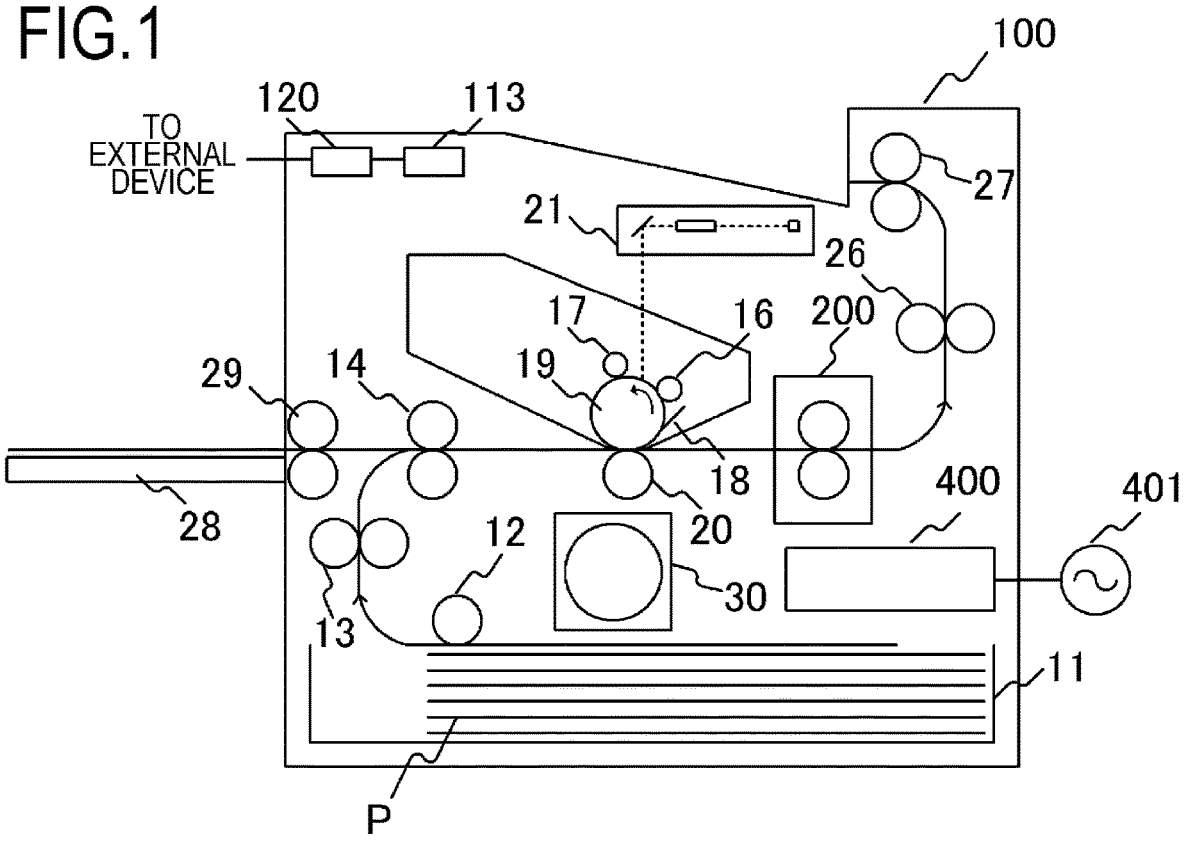
FIG. 1 is a schematic sectional view of an image forming apparatus according to an example of the present invention.

FIG. 1 is a schematic sectional view of an image forming apparatus according to an example of the present invention. Examples of image forming apparatuses to which the present invention is applicable include copiers, printers, and the like which utilize an electrophotographic system or an electrostatic recording system, and a case where the present invention is applied to a laser printer that uses an electrophotographic system to form images on a recording material P will be described below.

An image forming apparatus 100 includes a video controller 120 and a control portion 113. As an acquiring portion which acquires information of an image formed on a recording material, the video controller 120 receives and processes image information and a print instruction transmitted from an external device such as a personal computer. The control portion 113 is connected to the video controller 120 and controls respective portions constituting the image forming apparatus 100 in accordance with instructions from the video controller 120. When the video controller 120 receives a print instruction from the external device, image formation is executed through the following operations.

When a print signal is generated, a scanner unit 21 emits laser light modulated in accordance with image information to scan a surface of a photosensitive drum 19 charged to a prescribed polarity by a charging roller 16. Accordingly, an electrostatic latent image is formed on the photosensitive drum 19. When the electrostatic latent image on the photosensitive drum 19 is supplied with toner from a developing roller 17, the electrostatic latent image is developed as a toner image. Meanwhile, a recording material (a recording paper) P stacked in a paper feeding cassette 11 is fed one by one by a pickup roller 12, and transported toward a resist roller pair 14 by a transporting roller pair 13. Furthermore, the recording material P is transported in synchronization with the arrival of the toner image on the photosensitive drum 19 at a transfer position formed by the photosensitive drum 19 and a transfer roller 20 from the resist roller pair 14 to the transfer position. The toner image on the photosensitive drum 19 is transferred to the recording material P as the recording material P passes the transfer position. Subsequently, the recording material P is heated by a fixing apparatus 200 as a fixing portion (an image heating portion) and the toner image is fixed by heat to the recording material P. The recording material P bearing the fixed toner image is discharged to a tray in an upper part of the image forming apparatus 100 by transporting roller pairs 26 and 27. A drum cleaner 18 cleans toner remaining on the photosensitive drum 19. A paper feeding tray (a manual feeding tray) 28 having a pair of recording material restricting plates of which a width is adjustable in accordance with a size of the recording material P is provided in order to accommodate recording materials P of sizes other than regular sizes. A pickup roller 29 feeds the recording material P from the paper feeding tray 28. The image forming apparatus main body 100 has a motor 30 which drives the fixing apparatus 200 and the like. A control circuit 400 as heater driving means and an electrification control portion connected to a commercial AC power supply 401 supplies power to the fixing apparatus 200. The photosensitive drum 19, the charging roller 16, the scanner unit 21, the developing roller 17, and the transfer roller 20 described above constitute an image forming portion which forms an unfixed image on the recording material P. In addition, in the present example, a developing unit including the photosensitive drum 19, the charging roller 16, and the developing roller 17 and a cleaning unit including the drum cleaner 18 are configured as a process cartridge 15 that is attachable to and detachable from the apparatus main body of the image forming apparatus 100.

The image forming apparatus 100 according to the present example has a maximum paper-passing width of 216 mm in the longitudinal direction that is perpendicular to a transport direction of the recording material and a recording material transport speed of 300 mm/sec.

2. Configuration of Image Heating Apparatus

Figure 2:
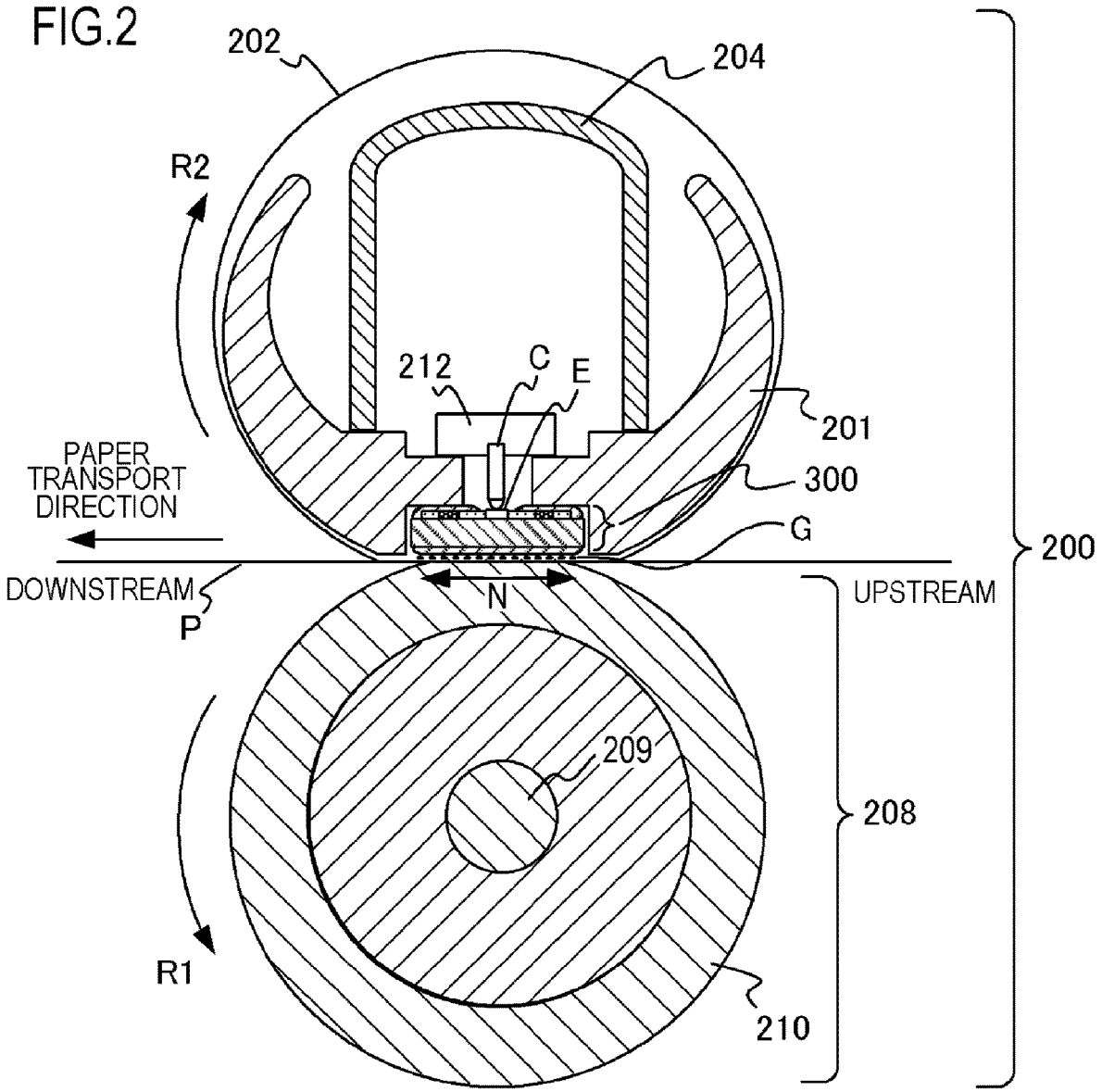
FIG. 2 is a schematic sectional view of an image heating apparatus according to Example 1.

FIG. 2 is a schematic sectional view of the fixing apparatus 200 as an image heating apparatus according to the present example. The fixing apparatus 200 includes a fixing film 202 as an endless belt, a heater 300 that comes into contact with an inner surface of the fixing film 202, and a pressure roller 208 which forms a fixing nip portion N together with the heater 300 via the fixing film 202, and a metal stay 204.

The fixing film 202 is a multilayer heat-resistant film formed in a cylindrical shape and uses a heat-resistant resin such as polyimide or a metal such as stainless steel as a base layer. In addition, a releasing layer for preventing toner adhesion and securing separability from the recording material P is formed on a surface of the fixing film 202 by covering the surface of the fixing film 202 with a heat-resistant resin with superior releasability such as a tetrafluoroethylene-perfluoroalkyl vinyl ether copolymer (PFA). Furthermore, in order to improve image quality, heat-resistant rubber such as silicone rubber may be formed as an elastic layer between the base layer and the releasing layer.

The pressure roller 208 includes a core metal 209 made of a material such as iron or aluminum and an elastic layer 210 made of a material such as silicone rubber.

The heater 300 is held by a heater holding member 201 made of a heat-resistant resin and heats the fixing film 202 by heating heated regions $A_1$ to $A_7$ (to be described in detail later) provided in the fixing nip portion N. The heater holding member 201 also has a guiding function for guiding rotation of the fixing film 202. The heater 300 is provided with an electrode E on an opposite side to the fixing nip portion N, and power is fed to the electrode E from an electrical contact C. The metal stay 204 receives a pressurizing force (not illustrated) and presses the heater holding member 201 toward the pressure roller 208. In addition, a safety element 212 which is a thermo-switch, a temperature fuse, or the like and which is actuated by abnormal heat generation of the heater 300 to interrupt power supplied to the heater 300 is arranged with respect to the heater 300 via the heater holding member 201.

The pressure roller 208 receives power from the motor 30 shown in FIG. 1 and rotates in a direction of an arrow R1. The rotation of the pressure roller 208 is followed by a rotation of the fixing film 202 in a direction of an arrow R2. An unfixed toner image on the recording material P is fixed by applying heat of the fixing film 202 while sandwiching and transporting the recording material P at the fixing nip portion N. In addition, in order to ensure slidability of the fixing film 202 and to create a state of stable driven rotation, a grease G is interposed between the heater 300 and the fixing film 202 as a lubricant. In the present example, HP300 manufactured by Dow Toray Co., Ltd. is used as the grease G and applied to a contact surface with the inner surface of the fixing film 202 in the heater 300.

3. Configuration of Heater

Figure 3A:
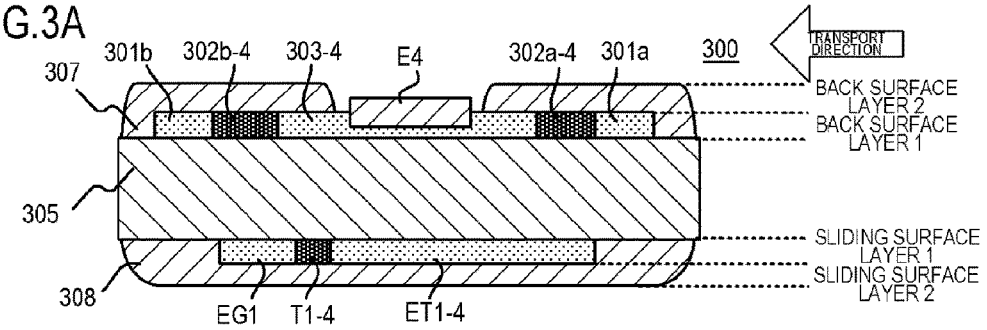
FIGS. 3A to 3C are configuration diagrams of a heater according to Example 1.

A configuration of the heater 300 according to the present example will be described with reference to FIGS. 3A to 3C. FIG. 3A is a sectional view of the heater 300, FIG. 3B is a plan view of respective layers of the heater 300, and FIG. 3C is a diagram illustrating a connection method of the electrical contact C to the heater 300.

Figure 3B:
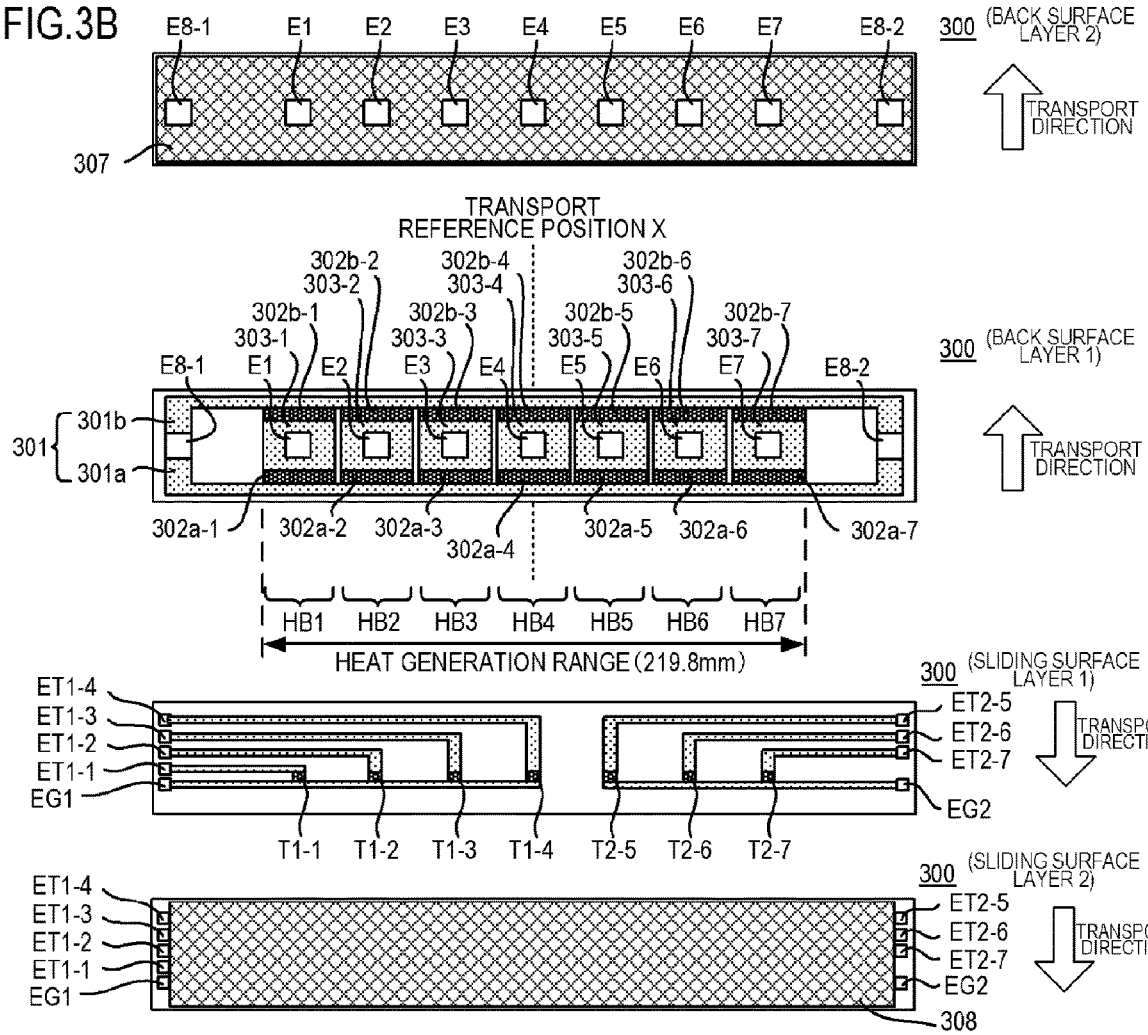
Figure 3C:
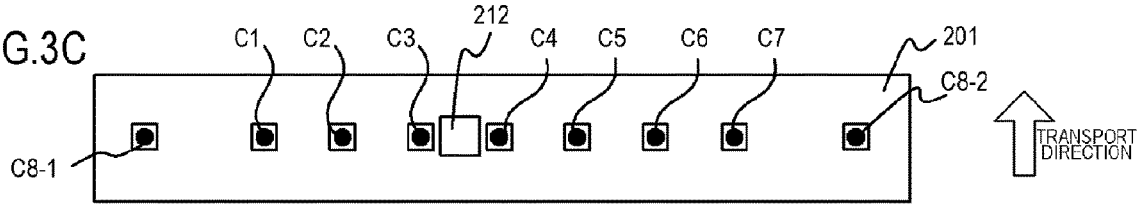

FIG. 3B shows a transport reference position X of the recording material P in the image forming apparatus 100 according to the present example. The transport reference in the present example is a center reference, and the recording material P is transported so that a center line in a direction perpendicular to the transport direction of the recording material P follows the transport reference position X. In addition, FIG. 3A represents a sectional view of the heater 300 at the transport reference position X.

The heater 300 is constituted by a substrate 305 made of a ceramic, a back surface layer 1 provided on the substrate 305, a back surface layer 2 covering the back surface layer 1, a sliding surface layer 1 provided on a surface of the substrate 305 on an opposite side to the back surface layer 1, and a sliding surface layer 2 covering the sliding surface layer 1.

The back surface layer 1 has a conductor 301 (301*a* and 301*b*) provided in a longitudinal direction of the heater 300. The conductor 301 is separated into the conductor 301*a* and the conductor 301*b*, and the conductor 301*b* is provided on a downstream side in the transport direction of the recording material P with respect to the conductor 301*a*. In addition, the back surface layer 1 has conductors 303 (303-1 to 303-7) provided parallel to the conductors 301*a* and 301*b*. The conductors 303 are provided in the longitudinal direction of the heater 300 between the conductor 301*a* and the conductor 301*b*.

Furthermore, the back surface layer 1 has heat generating elements 302*a* (302*a*-1 to 302*a*-7) and heat generating elements 302*b* (302*b*-1 to 302*b*-7) which are heating resistors that generate heat by being energized. The heat generating elements 302*a* are provided between the conductor 301*a* and the conductors 303 and generate heat due to power supplied via the conductor 301*a* and the conductors 303. The heat generating elements 302*b* are provided between the conductor 301*b* and the conductors 303 and generate heat due to power supplied via the conductor 301*b* and the conductors 303.

A heat generating part constituted by the conductor 301, the conductors 303, the heat generating elements 302*a*, and the heat generating elements 302*b* is divided into seven heat generating blocks (HB-1 to HB-7) in the longitudinal direction of the heater 300. In other words, the heat generating elements 302*a* are divided into seven regions of the heat generating elements 302*a*-1 to 302*a*-7 in the longitudinal direction of the heater 300. In addition, the heat generating elements 302*b* are divided into seven regions of the heat generating elements 302*b*-1 to 302*b*-7 in the longitudinal direction of the heater 300. Furthermore, the conductors 303 are divided into seven regions of the conductors 303-1 to 303-7 in accordance with the dividing positions of the heat generating elements 302*a* and 302*b*. A heat generation amount of each of the seven heat generating blocks (HB1 to HB7) is individually controlled by individually controlling power supplied to the heating resistors in each block. Accordingly, heated regions $A_1$ to $A_7$ formed divided in plurality in the longitudinal direction in the fixing nip portion N are individually heated.

A heat generation range according to the present example is a range from a left end of the heat generating block HB1 in the diagram to a right end of the heat generating block HB7 in the diagram, and a total length of the heat generation range is 219.8 mm. In addition, while the heat generating blocks respectively have a same length in the longitudinal direction of 31.4 mm, the heat generating blocks may have different lengths in the longitudinal direction.

In addition, the back surface layer 1 has electrodes E (E1 to E7, E8-1, and E8-2). The electrodes E1 to E7 are respectively provided in regions of the conductors 303-1 to 303-7 and are electrodes for supplying power to the respective heat generating blocks HB1 to HB7 via the conductors 303-1 to 303-7. The electrodes E8-1 and E8-2 are provided at ends of the heater 300 in the longitudinal direction so as to be connected to the conductors 301 and are electrodes for supplying power to the heat generating blocks HB1 to HB7 via the conductor 301. While the electrodes E8-1 and E8-2 are provided at both ends of the heater 300 in the longitudinal direction in the present example, for example, a configuration may be adopted in which only the electrode E8-1 is provided on one side. In addition, while power is supplied to the conductors 301*a* and 301*b* by a common electrode, the conductors 301*a* and the conductors 301*b* may be provided with separate electrodes and power supply may be performed separately.

The back surface layer 2 is constituted by a surface protection layer 307 (in the present example, glass) having an insulating property and covers the conductor 301, the conductors 303, and the heat generating elements 302*a* and 302*b*. In addition, the surface protection layer 307 is formed with the exception of locations of the electrodes E and is configured such that the electrical contact C can be connected to the electrodes E from a side of the back surface layer 2 of the heater.

The sliding surface layer 1 is provided on a surface on an opposite side to the surface on which the back surface layer 1 is provided in the substrate 305 and has thermistors TH (TH1-1 to TH1-4 and TH2-5 to TH2-7) as detecting means for detecting a temperature of each heat generating block HB-1 to HB-7. The thermistors TH are made of a material with PTC characteristics or NTC characteristics, and the temperatures of all heat generating blocks can be detected by detecting a resistance value of the heat generating blocks.

In addition, in order to energize the thermistors TH and detect a resistance value thereof, the sliding surface layer 1 has conductors ET (ET1-1 to ET1-4 and ET2-5 to ET2-7) and conductors EG (EG1 and EG2). The conductors ET1-1 to ET1-4 are respectively connected to the thermistors TH1-1 to TH1-4. The conductors ET2-5 to ET2-7 are respectively connected to the thermistors TH2-5 to TH2-7. The conductor EG1 is connected to the four thermistors TH1-1 to TH1-4 and forms a common conduction path. The conductor EG2 is connected to the three thermistors TH2-5 to TH2-7 and forms a common conduction path. The conductors ET and the conductors EG are respectively formed in the longitudinal direction of the heater 300 up to longitudinal ends thereof and are connected at the longitudinal ends of the heater to the control circuit 400 via an electrical contact (not illustrated).

The sliding surface layer 2 is constituted by a surface protection layer 308 (in the present example, glass) having slidability and an insulating property and covers the thermistors TH, the conductors ET, and the conductors EG while ensuring slidability with the inner surface of the fixing film 202. In addition, the surface protection layer 308 is formed with the exception of both longitudinal ends of the heater 300 in order to provide electrical contacts with respect to the conductors ET and the conductors EG.

Next, a connection method of the electrical contacts C to the respective electrodes E will be described. FIG. 3C is a plan view from the side of the heater holding member 201 showing how each electrical contact C is connected to each electrode E. The heater holding member 201 is provided with through-holes at positions corresponding to the electrodes E (E1 to E7, E8-1, and E8-2). At each through-hole position, each of the electrical contacts C (C1 to C7, C8-1, and C8-2) is electrically connected by means such as biasing by a spring or welding to each of the electrodes E (E1 to E7, E8-1, and E8-2). Each electrical contact C is connected to the control circuit 400 (to be described later) of the heater 300 via a conductive material (not illustrated) provided between the metal stay 204 and the heater holding member 201.

4. Configuration of Heater Control Circuit

Figure 4:
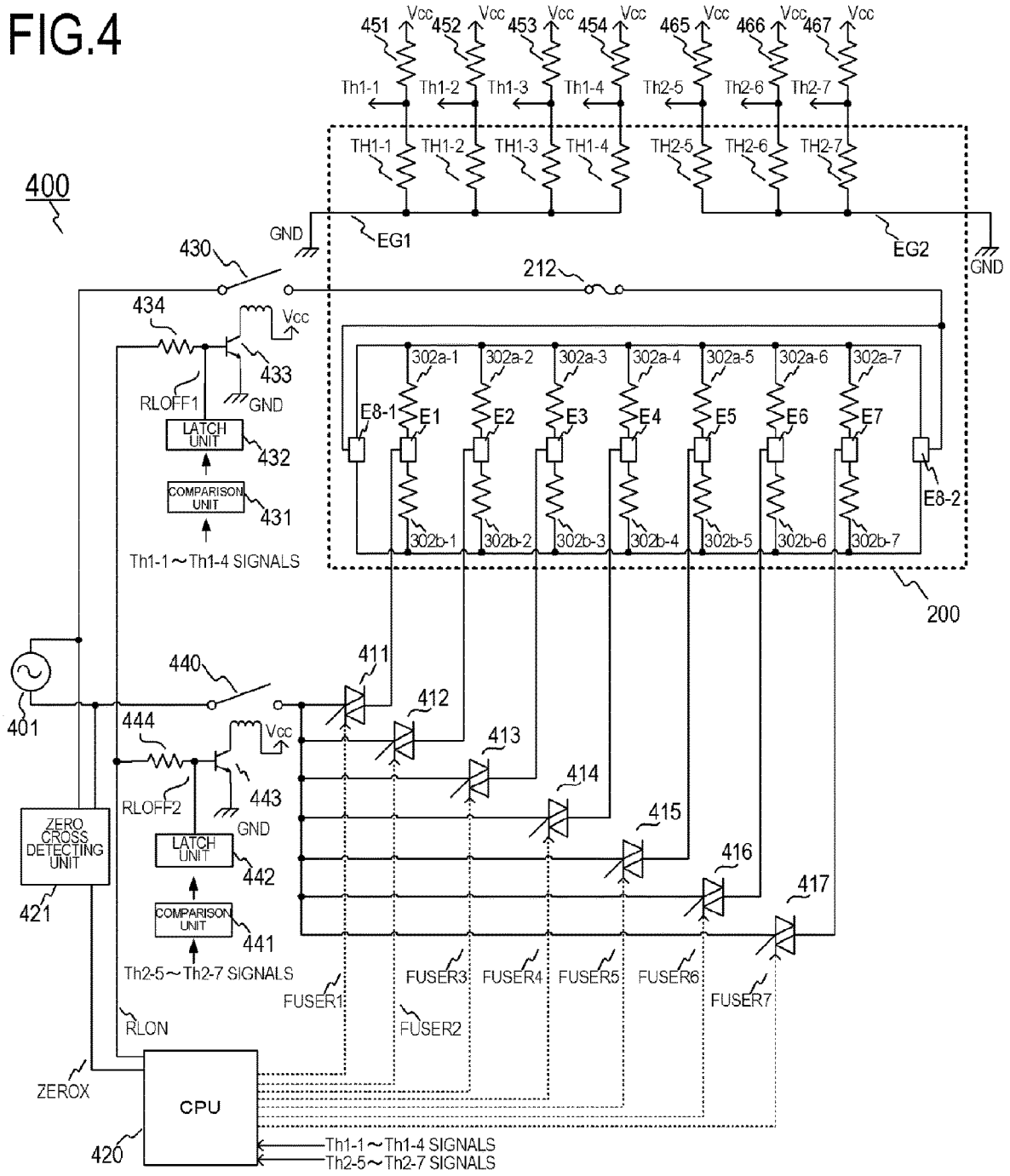
FIG. 4 is a control circuit diagram of the heater according to Example 1.

FIG. 4 shows a circuit diagram of the control circuit 400 of the heater 300 according to Example 1. A commercial AC power supply 401 is connected to the image forming apparatus 100. Power control of the heater 300 is performed by energizing/interrupting energization of triacs 411 to 417. The triacs 411 to 417 respectively operate in accordance with signals FUSER1 to FUSER7 from a CPU 420. Driving circuits of the triacs 411 to 417 are shown in an abbreviated form. The control circuit 400 of the heater 300 has a circuit configuration which enables the seven heat generating blocks HB1 to HB7 to be individually and independently controlled with the seven triacs 411 to 417. A zero-cross detecting unit 421 is a circuit which detects a zero cross of the AC power supply 401 and which outputs a ZEROX signal to the CPU 420. The ZEROX signal is used for detecting timings of phase control and wave number control of the triacs 411 to 417 and the like.

A method of detecting the temperature of the heater 300 will now be described. Temperature detection of the heater 300 is performed by the thermistors TH (TH1-1 to TH1-4 and TH2-5 to TH2-7). Divided voltage of the thermistors TH1-1 to TH1-4 and resistors 451 to 454 is detected as signals Th1-1 to Th1-4 by the CPU 420, and the CPU 420 converts the signals Th1-1 to Th1-4 into temperature. In a similar manner, divided voltage of the thermistors TH2-5 to TH2-7 and resistors 465 to 467 is detected as signals Th2-5 to Th2-7 by the CPU 420, and the CPU 420 converts the signals Th2-5 to Th2-7 into temperature.

In internal processing by the CPU 420, power to be supplied is calculated by, for example, PI control (proportional-integral control) based on a target temperature (a control target temperature) of each heat generating block (to be described later) and a detected temperature of a thermistor. Furthermore, supplied power is converted into a control level of a phase angle (phase control) or a wave number (wave number control) corresponding to the power, and the triacs 411 to 417 are controlled based on control conditions thereof. The CPU 420 executes various arithmetic operations, energization control, and the like related to temperature regulation control of the heater 300 as a control portion and an acquiring portion according to the present invention.

A relay 430 and a relay 440 are used as means which interrupt power to the heater 300 when the temperature of the heater 300 rises excessively due to a failure or the like.

Circuit operations of the relay 430 and the relay 440 will now be described. When a RLON signal assumes a High state, a transistor 433 is switched to an ON state, a secondary-side coil of the relay 430 is energized by a power supply voltage Vcc, and a primary-side contact of the relay 430 is switched to an ON state. When the RLON signal assumes a Low state, the transistor 433 is switched to an OFF state, a current flowing from the power supply voltage Vcc to the secondary-side coil of the relay 430 is interrupted, and the primary-side contact of the relay 430 is switched to an OFF state. In a similar manner, when the RLON signal assumes a High state, a transistor 443 is switched to an ON state, a secondary-side coil of the relay 440 is energized by the power supply voltage Vcc, and a primary-side contact of the relay 440 is switched to an ON state. When the RLON signal assumes a Low state, the transistor 443 is switched to an OFF state, a current flowing from the power supply voltage Vcc to the secondary-side coil of the relay 440 is interrupted, and the primary-side contact of the relay 440 is switched to an OFF state. Moreover, a resistor 434 and a resistor 444 are current-limiting resistors.

Operations of a safety circuit using the relay 430 and the relay 440 will now be described. When any one of the detected temperatures of the thermistors TH1-1 to TH1-4 exceeds a respectively set prescribed value, a comparison unit 431 operates a latch unit 432 and the latch unit 432 latches an RLOFF1 signal in a Low state. When the RLOFF1 signal assumes a Low state, since the transistor 433 is kept in an OFF state even when the CPU 420 changes the RLON signal to a High state, the relay 430 can be kept in an OFF state (a safe state). Moreover, in a non-latched state, the latch unit 432 sets the RLOFF1 signal to open-state output. In a similar manner, when any one of the detected temperatures of the thermistors TH2-5 to TH2-7 exceeds a respectively set prescribed value, a comparison unit 441 operates a latch unit 442 and the latch unit 442 latches an RLOFF2 signal in a Low state. When the RLOFF2 signal assumes a Low state, since the transistor 443 is kept in an OFF state even when the CPU 420 changes the RLON signal to a High state, the relay 440 can be kept in an OFF state (a safe state). In a similar manner, in a non-latched state, the latch unit 442 sets the RLOFF2 signal to open-state output.

5. Heater Control Method in Accordance with Image Information

In the image forming apparatus according to the present embodiment, power supply to the seven heat generating blocks HB1 to HB7 of the heater 300 is controlled in accordance with image data (image information) transmitted from an external device (not illustrated) such as a host computer and a heating mode selected when printing the recording material P.

Figure 5:
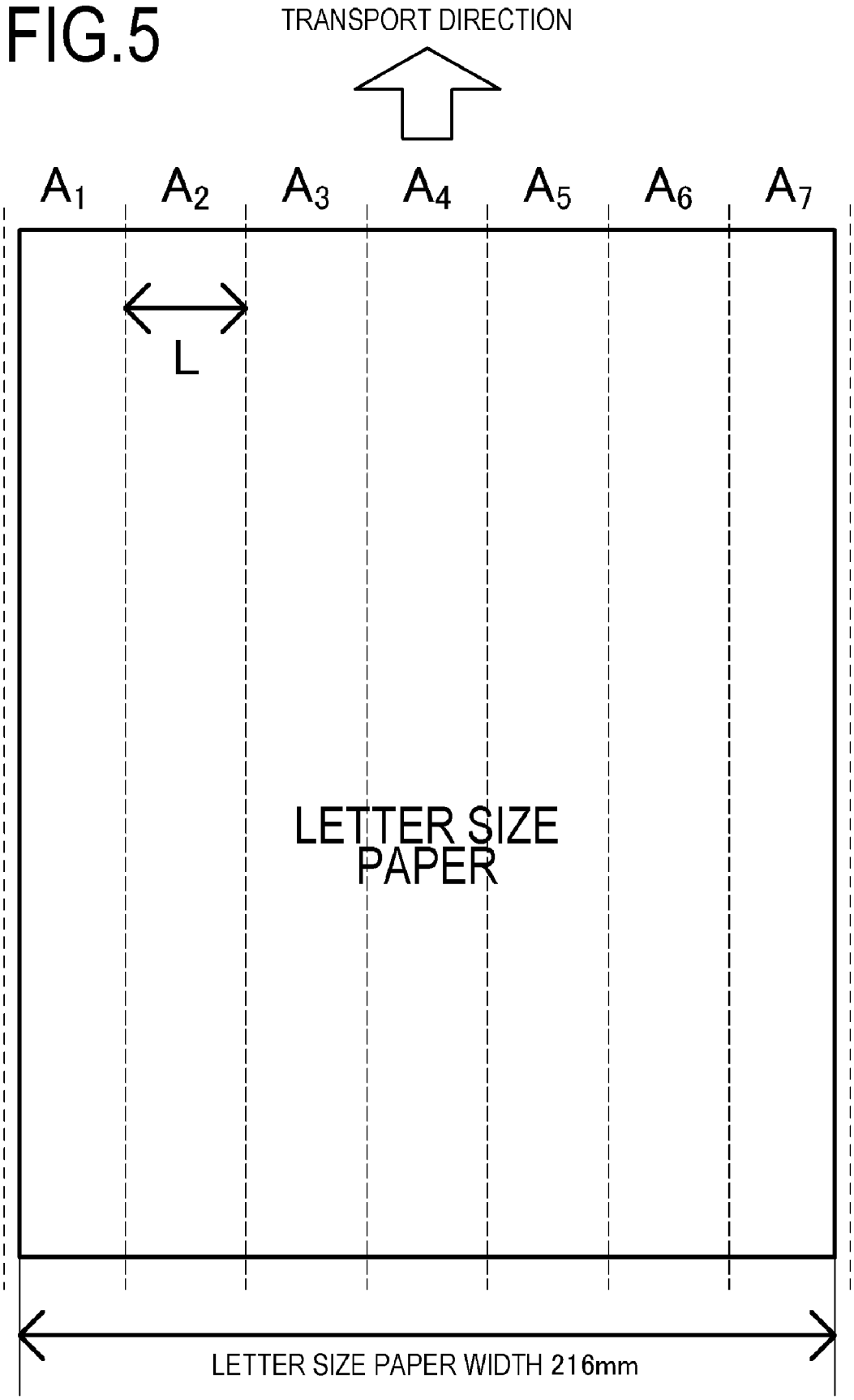
FIG. 5 is a diagram showing heated regions $A_1$ to $A_7$ according to Example 1.

FIG. 5 is a diagram showing the seven heated regions $A_1$ to $A_7$ divided in the longitudinal direction according to the present example in comparison with a size of a LETTER size paper. The heated regions $A_1$ to $A_7$ correspond to the heat generating blocks HB1 to HB7 and are configured such that, for example, the heated region $A_1$ is heated by the heat generating block HB1 and the heated region $A_7$ is heated by the heat generating block HB7. In the present example, a total length of the heated regions $A_1$ to $A_7$ is 219.8 mm, and each of the heated regions is a uniform 7-way division thereof (L=31.4 mm).

Image heating portions PR, non-image-heating portions PP, and a total length Lp in the longitudinal direction of the non-image-heating portions PP with respect to an image will now be described with reference to FIGS. 6A and 6B.

Figure 6A:
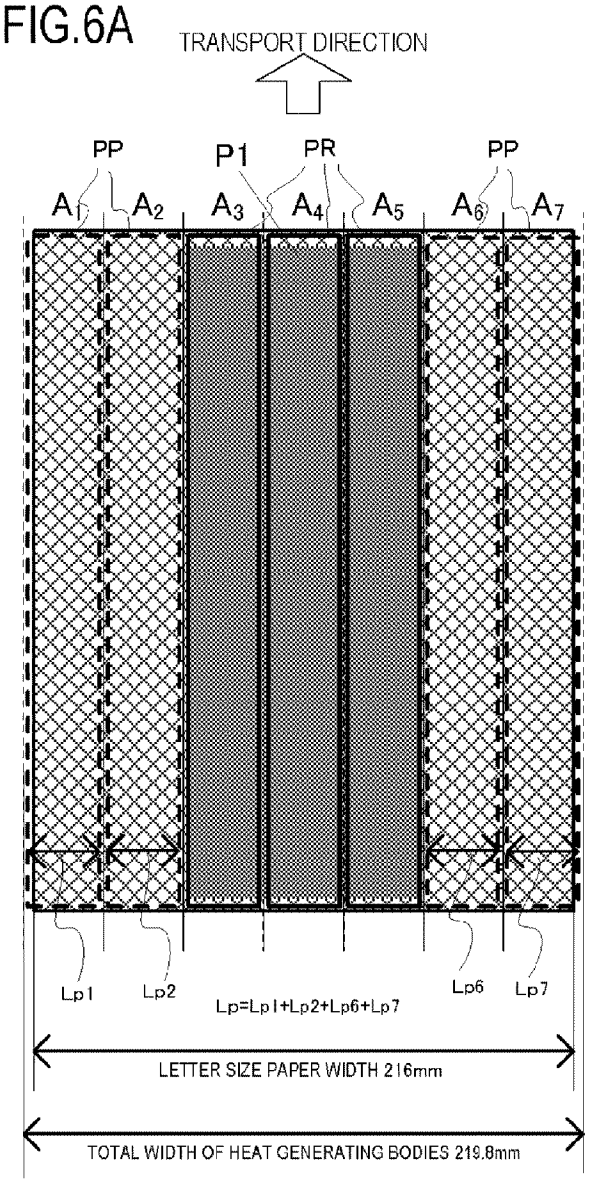
FIGS. 6A and 6B are diagrams showing an image P1 and non-image-heating portions PP according to Example 1.

FIG. 6A is a diagram showing the image heating portions PR, the non-image-heating portions PP, and the total length Lp in the longitudinal direction of the non-image-heating portions PP with respect to an image P1 in a case where the image P1 is formed in the heated regions $A_3$ to $A_5$. FIG. 6B is a diagram showing the image heating portions PR, the non-image-heating portions PP, and the total length Lp in the longitudinal direction of the non-image-heating portions PP in a case where the image P1 is formed divided between the heated regions $A_3$ and $A_5$.

In the diagrams, the recording material P (a shaded portion) represents a sheet of LTR-size paper. The image heating portions PR are sections in which a portion where image data is present is heated in each heated region or, in other words, heated regions through which an image formed on the recording material P passes among the respective heated regions, and are depicted by a bold frame overlapping the image P1 (a gray-tone portion) in the diagrams. In addition, the non-image-heating portions PP are sections excluding the image heating portions RP in each heated region or, in other words, heated regions through which an image formed on the recording material P does not pass among the respective heated regions, and is depicted by a bold frame formed by dash lines. In FIG. 6A, the image P1 is formed in the heated regions $A_3$ to $A_5$, and the entire heated regions $A_3$ to $A_5$ constitute the image heating portions PR. Since the image is not formed over entire regions in the transport direction in the heated regions $A_1$, $A_2$, $A_6$, and $A_7$, the entire regions of the heated regions $A_1$, $A_2$, $A_6$, and $A_7$ constitute the non-image-heating portions PP. If widths of the heated regions $A_1$, $A_2$, $A_6$, and $A_7$ are respectively denoted by Lp1, Lp2, Lp6, and Lp7, then Lp=Lp1+Lp2+Lp6+Lp7.

Figure 6B:
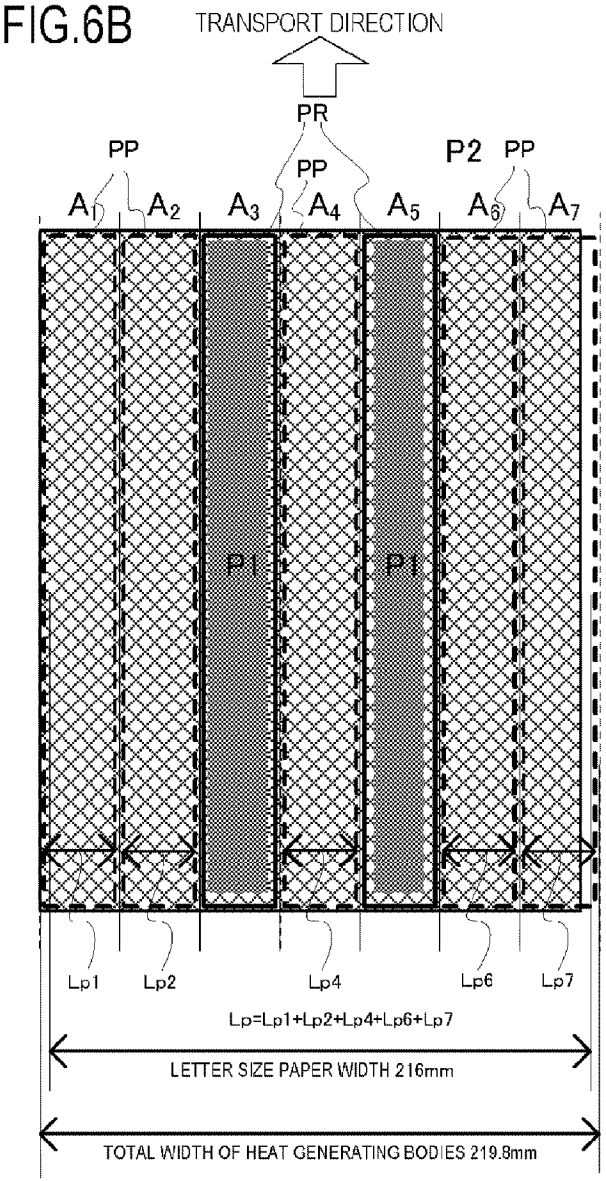

On the other hand, in FIG. 6B, the image P1 is formed in the heated regions $A_3$ and $A_5$, and the heated regions $A_3$ and $A_5$ constitute the image heating portions PR. If a width of the heated region $A_4$ is denoted by Lp4, then Lp=Lp1+Lp2+Lp4+Lp6+Lp7.

A flow of heater control in the present example will now be described.

First, the video controller 120 calculates and determines ranges of the image heating portions PR and the non-image-heating portions PP from image information received from the host computer. The control portion 113 controls a temperature of each heat generating block so that, when the image heating portions PR pass the fixing nip portion N, an unfixed toner image is fixed onto the recording material P. In the present example, a control target temperature $T_0$ of the image heating portion is set to 180° C. in an ordinary paper mode. In addition, a control target temperature of each heat generating block corresponding to the non-image-heating portions PP when the non-image-heating portions PP pass the fixing nip portion N (a control target temperature of non-image-heating portions) is set to a target temperature Tp that is lower than the target temperature $T_0$. Furthermore, the target temperature Tp is set in accordance with a total length Lp in the longitudinal direction of the heater of the non-image-heating portions PP passing the fixing nip portion N.

Figure 7:
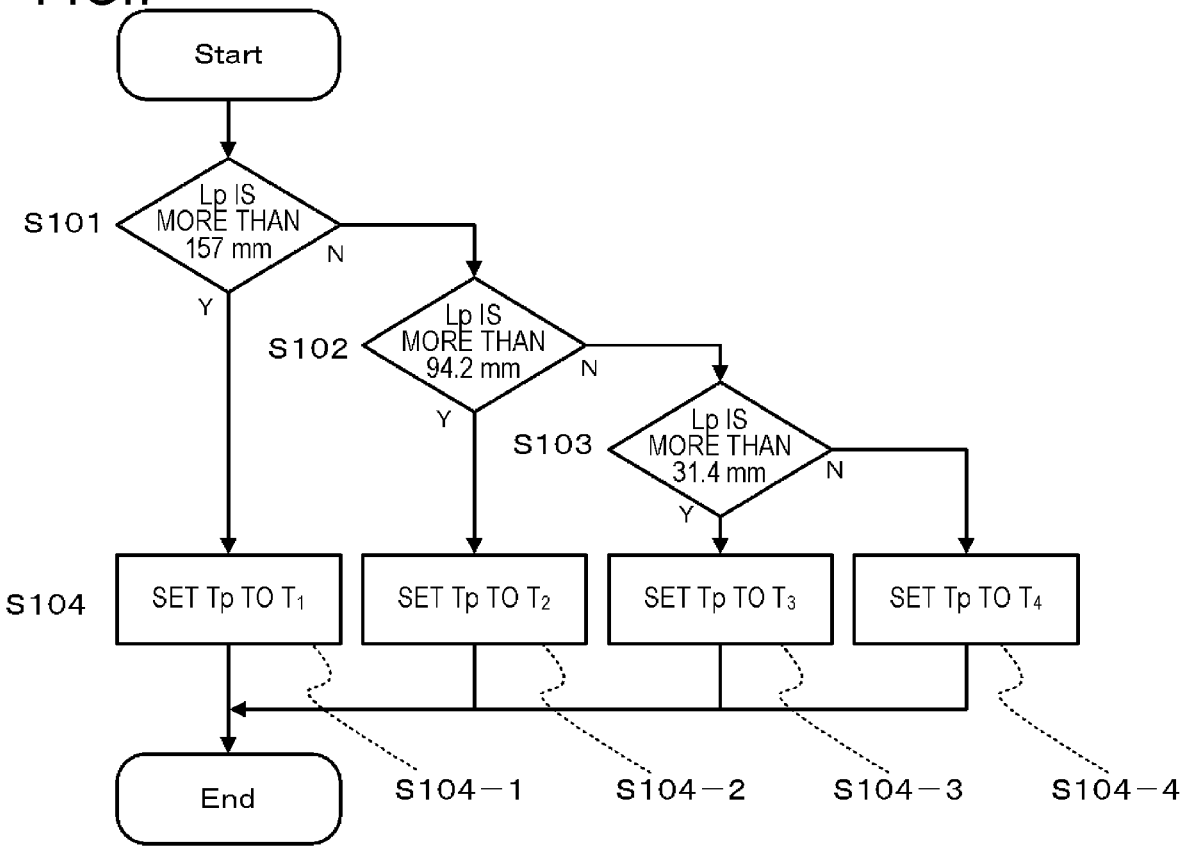
FIG. 7 is a flow chart showing a target temperature determination sequence according to Example 1.

FIG. 7 shows a determination sequence of the target temperature Tp.

Figure 8:
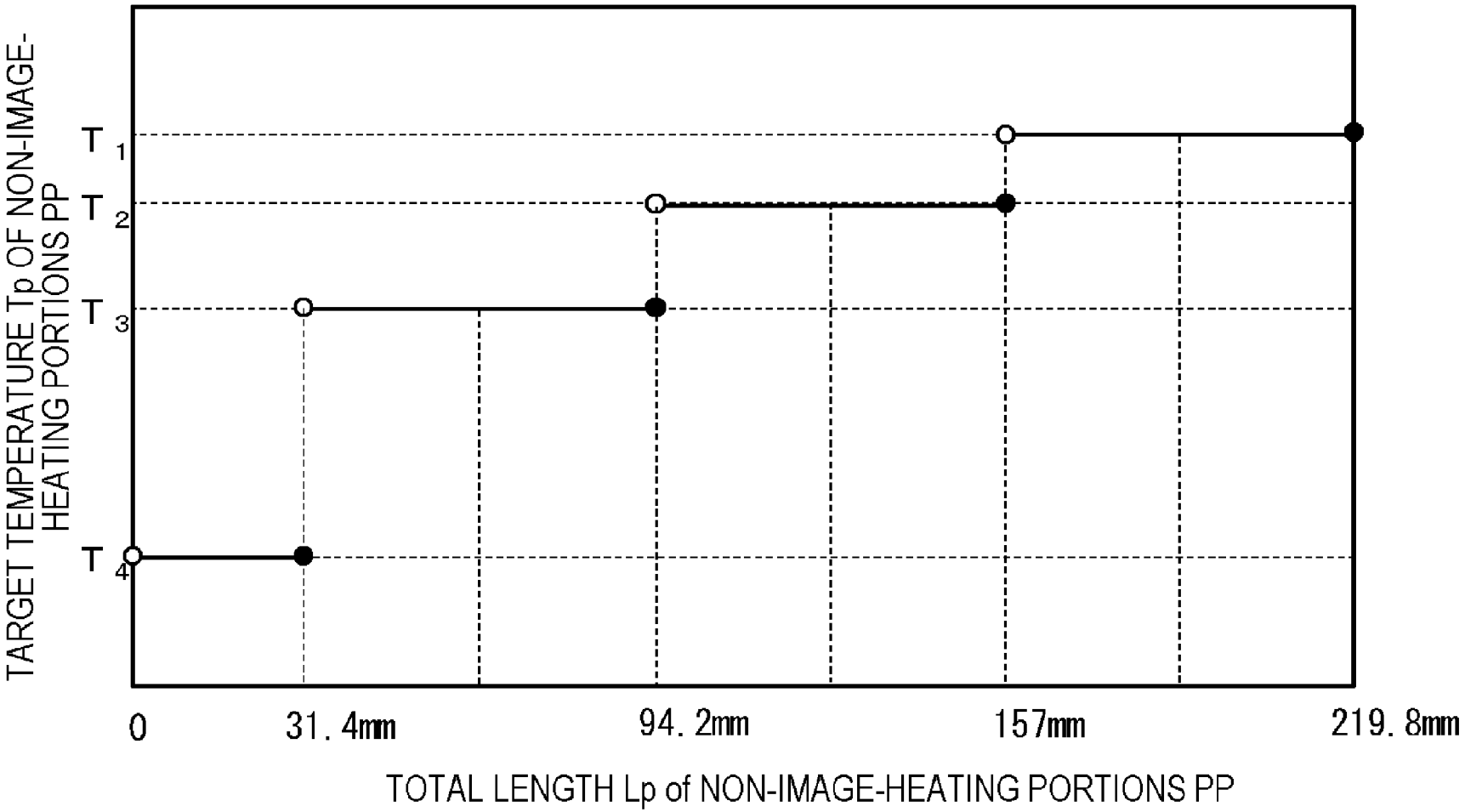
FIG. 8 is a relationship diagram between a length and a target temperature of a non-image-heating portion according to Example 1.

FIG. 8 is a schematic view showing a relationship between the total length Lp and the target temperature Tp of the non-image-heating portions PP. An abscissa represents the total length Lp of the non-image-heating portions PP and an ordinate represents the target temperature Tp of the non-image-heating portions PP. When the total length Lp is more than 157 mm, the target temperature Tp is set to $T_1$ that is a highest temperature (S101, S104-1). When the total length Lp is more than 94.2 mm and 157 mm or less, the target temperature Tp is set to $T_2$ that is a lower temperature than $T_1$ (S102, S104-2). When the total length Lp is more than 31.4 mm and 94.2 mm or less, the target temperature Tp is set to $T_3$ that is a lower temperature than $T_2$ (S103, S104-3). When the total length Lp is 31.4 mm or less, the target temperature Tp is set to $T_4$ that is a lowest temperature (S104-4). As described above, the target temperature Tp is set to be lower as the total length Lp decreases. $T_1$ to $T_4$ to be set as the target temperature Tp are values satisfying conditions to be described later and, in the present example, $T_1$ is set to 140° C., $T_2$ is set to 135° C., $T_3$ is set to 127° C., and $T_4$ is set to 107° C.

When a rotation torque of the fixing film exceeds Ms, a transport failure of the recording material occurs due to a rotation failure of the fixing film. $T_1$ to $T_4$ to be set as the target temperature Tp are temperatures satisfying a condition that the rotation torque of the fixing film is Ms or less.

The rotation torque of the fixing film represents friction forces between the fixing film and a film guide and/or the heater. Among such friction forces, the friction force between the fixing film and the heater at a position corresponding to the fixing nip portion is most dominant and, accordingly, the rotation torque of the fixing film is proportional to the friction force between the fixing film and the heater in the fixing nip portion.

The friction force between the fixing film and the heater in the fixing nip portion is dependent on viscosity of the grease interposed between the fixing film and the heater. The higher the viscosity of the grease, the greater a sliding frictional force per unit area between the fixing film and the heater and, consequently, the greater the friction force between the fixing film and the heater in the fixing nip portion.

In addition, the viscosity of the grease is dependent on a temperature of the grease. The lower the temperature of the grease, the higher the viscosity of the grease. The temperature of the grease at a given position in the longitudinal direction of the heater is dependent on a temperature of the heat generating block corresponding to the position. When the non-image-heating portions PP pass a region heated by the heat generating block at the position, the temperature of the heat generating block is regulated at the target temperature Tp that is lower than the target temperature $T_0$. As a result, the viscosity of the grease is higher when the non-image-heating portions PP pass than when the image heating portions PR pass. Therefore, the friction force between the fixing film and the heater in the fixing nip portion is greater and the rotation torque of the fixing film is higher when the non-image-heating portions PP pass as compared to when the image heating portions PR pass.

Figure 9:
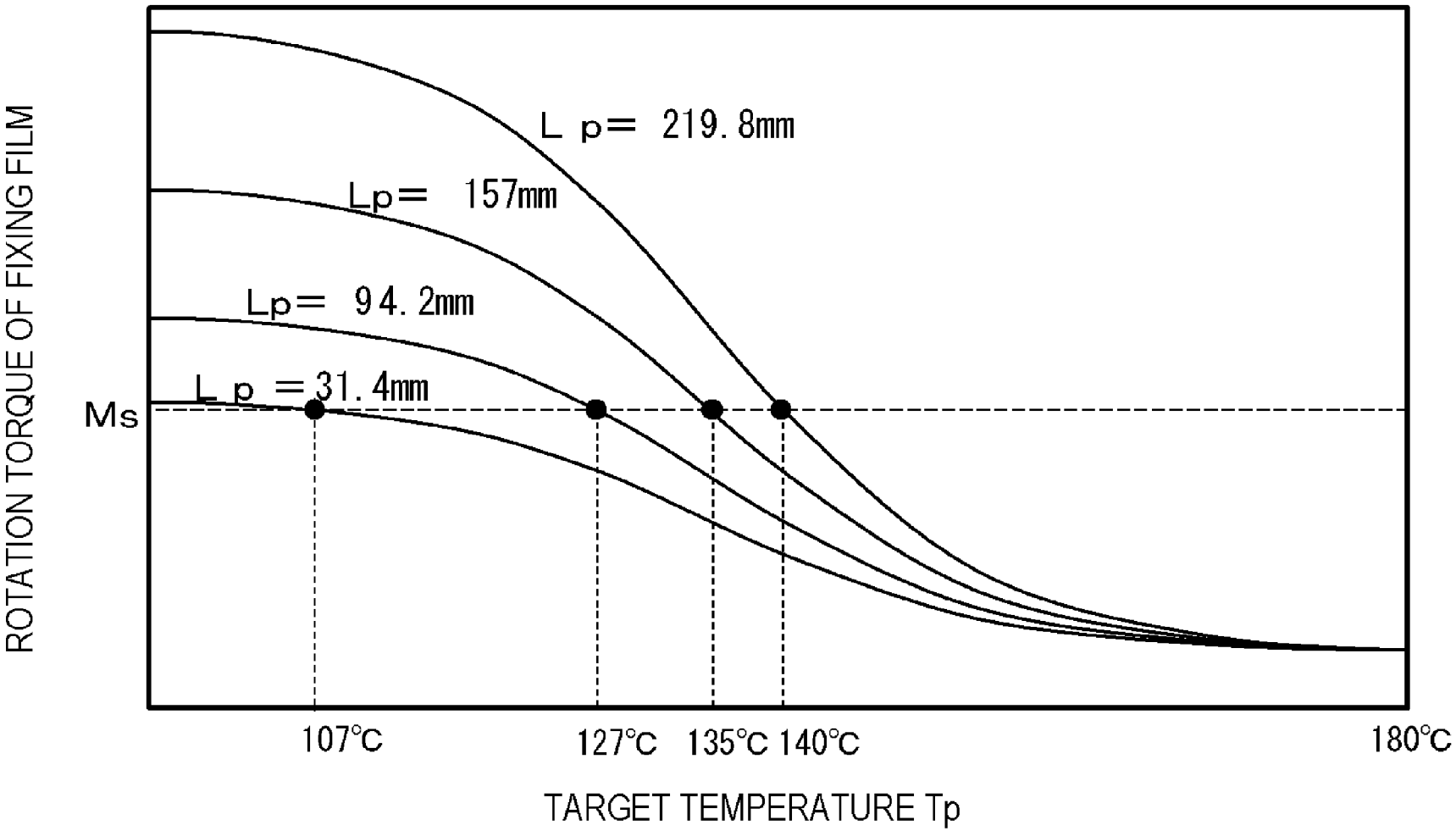
FIG. 9 is a diagram showing a relationship between a target temperature and a rotation torque of a fixing film.

FIG. 9 is a schematic view showing a relationship between the target temperature Tp and the rotation torque of the fixing film in four cases with different lengths Lp in the present example. As shown in FIG. 9, when the entire heated region is the non-image-heating portions PP or, in other words, when Lp=219.8 mm, the target temperature Tp must be set to 140° C. or higher in order to set the rotation torque of the fixing film to Ms or less. In consideration thereof, in the present example, 140° C. is set as the temperature $T_1$ that is the target temperature of heat generating blocks corresponding to the non-image-heating portions PP when the length Lp is more than 157 mm.

When the non-image-heating portions PP decrease, the decreased part is replaced with the image heating portions PR. In a replaced region, since temperature regulation is performed at the target temperature $T_0$ that is higher than the target temperature Tp, the viscosity of the grease in the region declines and the friction force between the fixing film and the heater decreases. The rotation torque of the fixing film can be kept to Ms or less by slightly lowering the target temperature Tp to increase the viscosity of the grease in the region corresponding to the non-image-heating portions PP in compensation for the decrease in the friction force between the fixing film and the heater. In other words, a configuration in which the rotation torque of the fixing film does not exceed a prescribed magnitude can be adopted by setting the target temperature Tp of heat generating blocks corresponding to the non-image-heating portions PP such that the larger a proportion of the image heating portions PR among a plurality of heated regions, the lower the target temperature Tp.

As shown in FIG. 9, in the present example, when the length Lp drops to 157 mm or less, the rotation torque of the fixing film remains equal to Ms or less and a rotation failure of the fixing film does not occur even when the target temperature Tp is lowered to 135° C. In consideration thereof, 135° C. is set as the temperature $T_2$ that is the target temperature when the length Lp is 157 mm or less.

In a similar manner, 127° C. is set as the temperature $T_3$ that is the target temperature when the length Lp is 94.2 mm or less. In addition, 107° C. is set as the temperature $T_4$ that is the target temperature when the length Lp is 31.4 mm or less.

6. Operational Effects According to Present Example

Comparative Example 1 in which the target temperature Tp is set to a fixed value of 140° C. regardless of a total length $L_{AN}$ of the non-image-heating portions PP will now be compared with the present example.

Table 1 represents a table comparing the target temperature Tp according to the present example with the target temperature Tp according to Comparative Example 1.

TABLE 1

| Total length Lp of non-image-heating portions PP | Target temperature Tp | |
|---|---|---|
| | Example 1 | Comparative Example 1 |
| 157 mm < Lp | 140° C. | 140° C. |
| 94.2 mm < Lp ≤ 157 mm | 135° C. | |
| 31.4 mm < Lp ≤ 94.2 mm | 127° C. | |
| Lp ≤ 31.4 mm | 107° C. | |

As shown in Table 1, under a condition expressed as Lp≤157 mm, the target temperature Tp can be lowered in the present example as compared to Comparative Example 1. Since lowering the temperature regulation setting of the heat generating blocks of the heater enables power supplied to the heat generating blocks of the heater to be reduced, power saving can be achieved.

While a description in terms of the target temperature Tp corresponding to a range of the total length Lp of four non-image-heating portions PP has been given in the present example, the present example is not limited to this condition and a target temperature can be arbitrarily set in consideration of a condition of an occurrence of a rotation failure of the fixing film.

In the present example, while lengths (widths) in the longitudinal direction of the heater of the respective heated regions $A_1$ to $A_7$ are the same, a target temperature may be set in a similar manner to the present example using an apparatus in which each heated region has a different width.

In the present example, the target temperature Tp of all heat generating blocks corresponding to the non-image-heating portions PP is set to a same temperature. However, each of a plurality of heat generating blocks corresponding to the non-image-heating portions PP may be set to a different temperature. For example, a temperature at ends of the image heating portions PR in the longitudinal direction of the heater more readily drops due to the presence of adjacent non-image-heating portions PP. Therefore, there is a possibility that an image formed in an image heating portion PR with an adjacent non-image-heating portion PP may experience faulty fixing. In consideration thereof, the target temperature Tp of a non-image-heating portion PP adjacent to an image heating portion PR among the non-image-heating portions PP may conceivably be set to a higher temperature than other non-image-heating portions PP in order to assist fixability of a toner image. In other words, among the non-image-heating portions PP, a target temperature of a first non-image-heating portion PP adjacent to an image heating portion PR is set to a first target temperature and a target temperature of a second non-image-heating portion PP not adjacent to an image heating portion PR is set to a second target temperature that is lower than the first target temperature. In such a case, all of the target temperatures of the plurality of heat generating blocks corresponding to the non-image-heating portions PP are set in accordance with the length Lp of the non-image-heating portions PP in a similar manner to the present example. Furthermore, a setting method may be adopted in which only the target temperature of a non-image-heating portion PP adjacent to an image heating portion PR is corrected so as to be higher than the target temperature of other non-image-heating portions PP by a prescribed value. Accordingly, power saving and favorable fixability of a toner image can be achieved while suppressing the rotation torque of the fixing film to Ms or less.

In addition, an average value of the target temperatures of the heat generating blocks corresponding to the non-image-heating portions PP may be adopted as the target temperature Tp. An average value of the target temperatures of the heat generating blocks corresponding to the non-image-heating portions PP used in this case will be described in detail below.

An example will now be described in which a heated region adjacent to an image heating portion PR in a non-image-heating portion PP is controlled at a higher temperature than non-image-heating portions other than adjacent heated regions. Let an adjacent heating portion PPB denote a heated region adjacent to an image heating portion PR in a non-image-heating portion PP, and let a non-adjacent heating portion PPU denote a heated region that is a non-image-heating portion other than the adjacent heating portion PPB or, in other words, a heated region not adjacent to an image heating portion PP.

Figure 10:
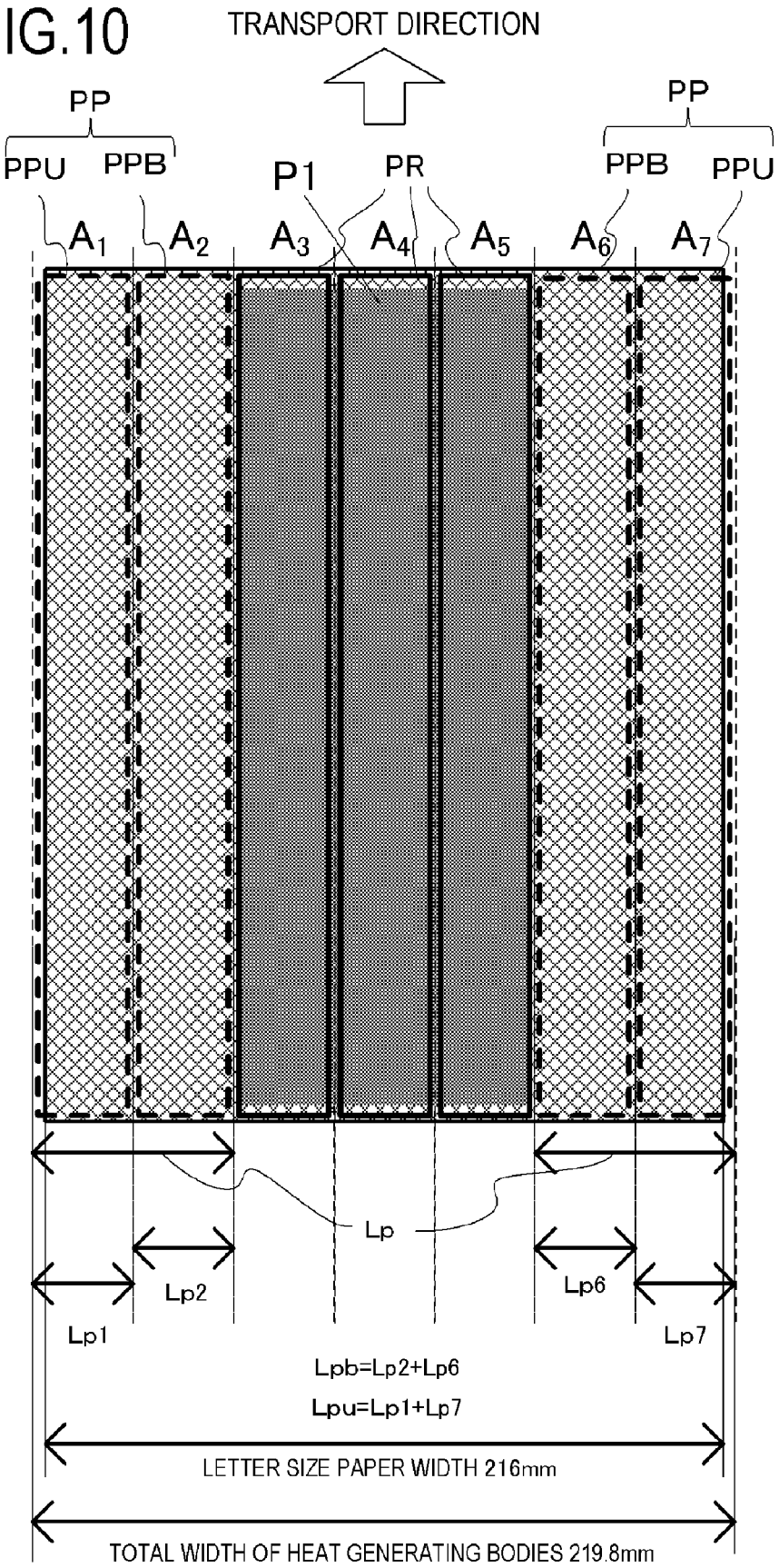
FIG. 10 is a diagram showing adjacent heating portions PPB and non-adjacent heating portions PPU.

FIG. 10 is a diagram showing an image P1 formed on the recording material P and image heating portions PR, adjacent heating portions PPB, and non-adjacent heating portions PPU with respect to the image P1. A total length of the adjacent heating portions PPB is denoted by Lpb (=Lp2+Lp6), and a total length of the non-adjacent heating portions PPU is denoted by Lpu (=Lp1+Lp7). Accordingly, the total length Lp of the non-image-heating portions PP is Lpb+Lpu. In FIG. 10, heat generating blocks corresponding to the adjacent heating portions PPB are $A_2$ and $A_6$, and the heat generating blocks $A_2$ and $A_6$ are controlled at a target temperature Tpb. Heat generating blocks corresponding to the non-adjacent heating portions PPU are $A_1$ and $A_7$, and the heat generating blocks $A_1$ and $A_7$ are controlled at a target temperature Tpu which is lower than the target temperature Tpb.

An average value Tav of the target temperatures of the heat generating blocks corresponding to the non-image-heating portions PP is obtained by dividing a sum of respective products of the target temperature of heat generating blocks and the total length of the adjacent heating portions PPB and the non-adjacent heating portions PPU by a sum of the total lengths of the adjacent heating portions PPB and the non-adjacent heating portions PPU. In other words, the average value Tav can be expressed by the following equation.

$$Tav=(Lpb\cdot Tpb+Lpu\cdot Tpu)/(Lpb+Lpu)$$

The target temperature Tpu and the target temperature Tpb are set so that the average value Tav of the target temperatures of the heat generating blocks corresponding to the non-image-heating portions PP calculated as described above varies in accordance with the total length Lp. Accordingly, power saving and favorable fixability of a toner image can be achieved while suppressing the rotation torque of the fixing film to Ms or less.

Example 2

Next, Example 2 of the present invention will be described. Basic configurations and operations of an image forming apparatus and an image heating apparatus according to Example 2 are the same as those of Example 1. Therefore, elements having functions or configurations that are the same as or comparable to the elements of Example 1 will be denoted by same reference characters and a detailed description thereof will be omitted.

A feature of Example 2 is that, unlike in Example 1, heater control in accordance with paper size information instead of image information is performed. Hereinafter, a heater control method according to the present example will be described.

In the image forming apparatus according to the present example, power supply to the seven heat generating blocks HB1 to HB7 of the heater 300 is controlled in accordance with paper size information transmitted from an external device.

Figure 11:
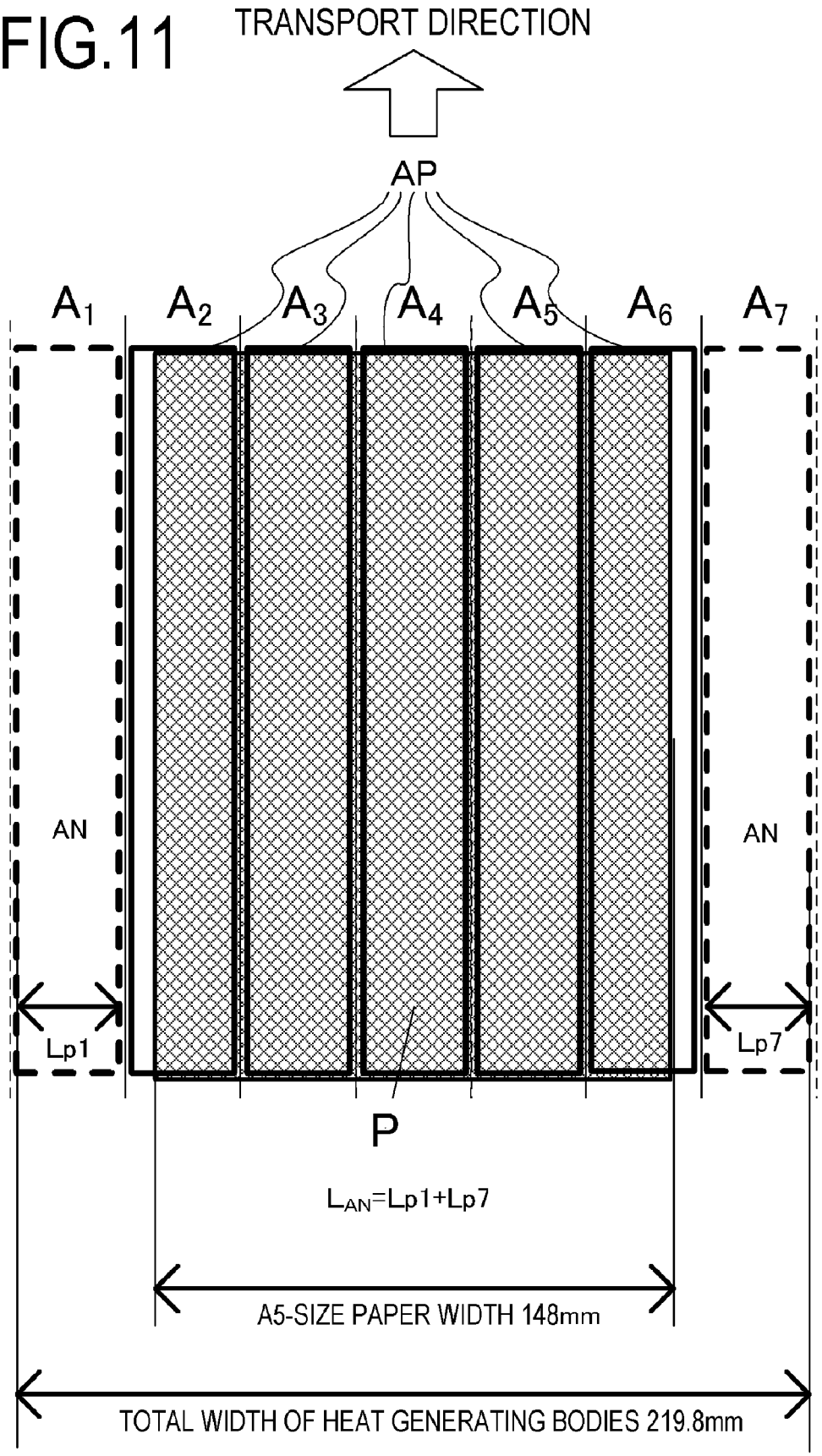
FIG. 11 is a diagram showing a recording material P and non-paper-passing heating portions AN according to Example 2.

FIG. 11 is a diagram showing a recording material P and paper-passing heating portions AP with respect to the recording material P according to the present example. In the diagram, the recording material P represents a sheet of A5-size paper. The paper-passing heating portions AP are sections in which the recording material P is heated in the respective heated regions or, in other words, heated regions through which the recording material passes among the plurality of heated regions, and are depicted by a bold frame overlapping the recording material P (a shaded portion) in the diagram. In addition, non-paper-passing heating portions AN are sections excluding the paper-passing heating portions AP in the heated regions or, in other words, heated regions through which the recording material does not pass among the plurality of heated regions, and are depicted by a bold frame formed by dash lines. The recording material P passes through the heated regions $A_2$ to $A_6$ and the entire regions of the heated regions $A_2$ to $A_6$ constitute the paper-passing heating portions AP. Since the recording material P does not pass over entire regions of the heated regions $A_1$ and $A_7$ in the longitudinal direction of the heater, the entire regions are non-paper-passing heating portions AN.

The video controller 120 calculates and determines ranges of the paper-passing heating portions AP and the non-paper-passing heating portions AN from paper size information received from the host computer. The control portion 113 controls temperature of each heat generating block so that, when the paper-passing heating portions AP pass the fixing nip portion N, an unfixed toner image is fixed onto the recording material P. In the present example, a target temperature $T_{AP}$ of the paper-passing heating portions is set to 180° C. in an ordinary paper mode. In addition, a target temperature $T_{AN}$ of the non-paper-passing heating portions AN is set to a temperature lower than the target temperature $T_{AP}$. Furthermore, the target temperature $T_{AN}$ is set in accordance with a total length $L_{AN}$ (=Lp1+Lp7) of the non-paper-passing heating portions AN.

Figure 12:
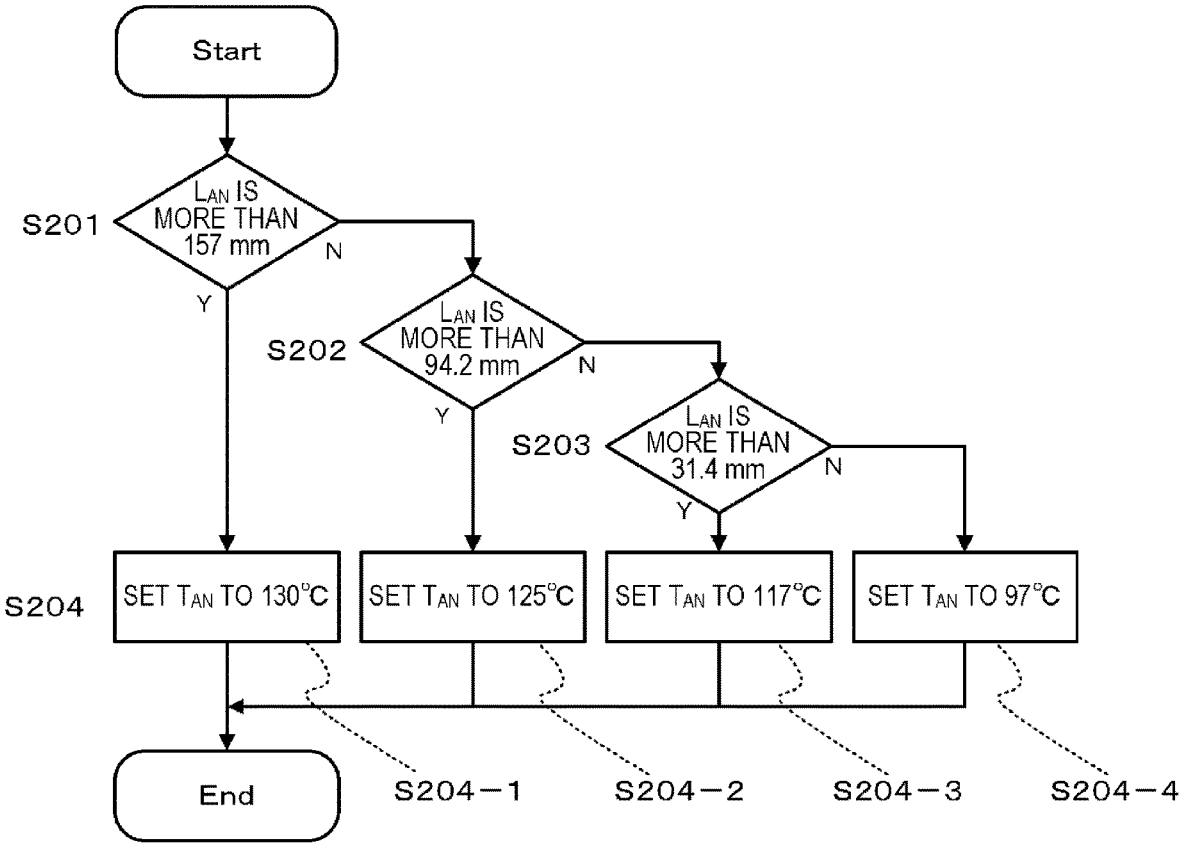
FIG. 12 is a flow chart showing a target temperature determination sequence according to Example 2.

FIG. 12 shows a determination sequence of the target temperature $T_{AN}$ according to the present example.

When the total length $L_{AN}$ is more than 157 mm, the target temperature $T_{AN}$ is set to 130° C. (S201, S204-1). When the total length $L_{AN}$ is more than 94.2 mm and 157 mm or less, the target temperature $T_{AN}$ is set to 125° C. (S202, S204-2).

When the total length $L_{AN}$ is more than 31.4 mm and 94.2 mm or less, the target temperature $T_{AN}$ is set to 117° C. (S203, S204-3). When the total length $L_{AN}$ is 31.4 mm or less, the target temperature $T_{AN}$ is set to 97° C. (S204-4).

It should be noted that the target temperature $T_{AN}$ according to Example 2 can be set lower than the target temperature Tp according to Example 1.

Since the recording material P is not present at positions corresponding to the non-paper-passing heating portions AN, absorption of heat by the recording material P is not performed. Therefore, even when the heat generating blocks corresponding to the non-paper-passing heating portions AN are set to a temperature lower than the heat generating blocks corresponding to the non-image-heating portions PP at paper-passing positions, the grease at positions of the non-paper-passing heating portions AN can be set to a temperature similar to the temperature of the grease at positions of the non-image-heating portions PP.

Comparative Example 2 in which the target temperature $T_{AN}$ is set to a fixed value of 130° C. regardless of the total length $L_{AN}$ of the non-paper-passing heating portions AN will now be compared with the present example. Table 2 is a table comparing the target temperatures $T_{AN}$ of the non-paper-passing heating portions AN according to the present example and Comparative Example 2.

TABLE 2

| Total length $L_{AN}$ of non-paper-passing heating portions AN | Target temperature $T_{AN}$ | |
|---|---|---|
| | Example 2 | Comparative Example 2 |
| 157 mm < $L_{AN}$ | 130° C. | 130° C. |
| 94.2 mm < $L_{AN}$ ≤ 157 mm | 125° C. | |
| 31.4 mm < $L_{AN}$ ≤ 94.2 mm | 117° C. | |
| $L_{AN}$ ≤ 31.4 mm | 97° C. | |

As shown in Table 2, under a condition expressed as $L_{AN}$≤157 mm, the target temperature $T_{AN}$ can be lowered in the present example as compared to Comparative Example 2 and power saving can be achieved.

Example 3

Next, Example 3 of the present invention will be described. Basic configurations and operations of an image forming apparatus and an image heating apparatus according to Example 3 are the same as those of Example 1. Elements having functions or configurations that are the same as or comparable to the elements of Example 1 will be denoted by same reference characters and a detailed description thereof will be omitted.

A feature of Example 3 is that heater control in accordance with both image information and paper size information is performed. Hereinafter, a heater control method according to the present example will be described.

In the image forming apparatus according to the present example, power supply to the seven heat generating blocks HB1 to HB7 of the heater 300 is controlled in accordance with image information and paper size information transmitted from an external device.

Figure 13:
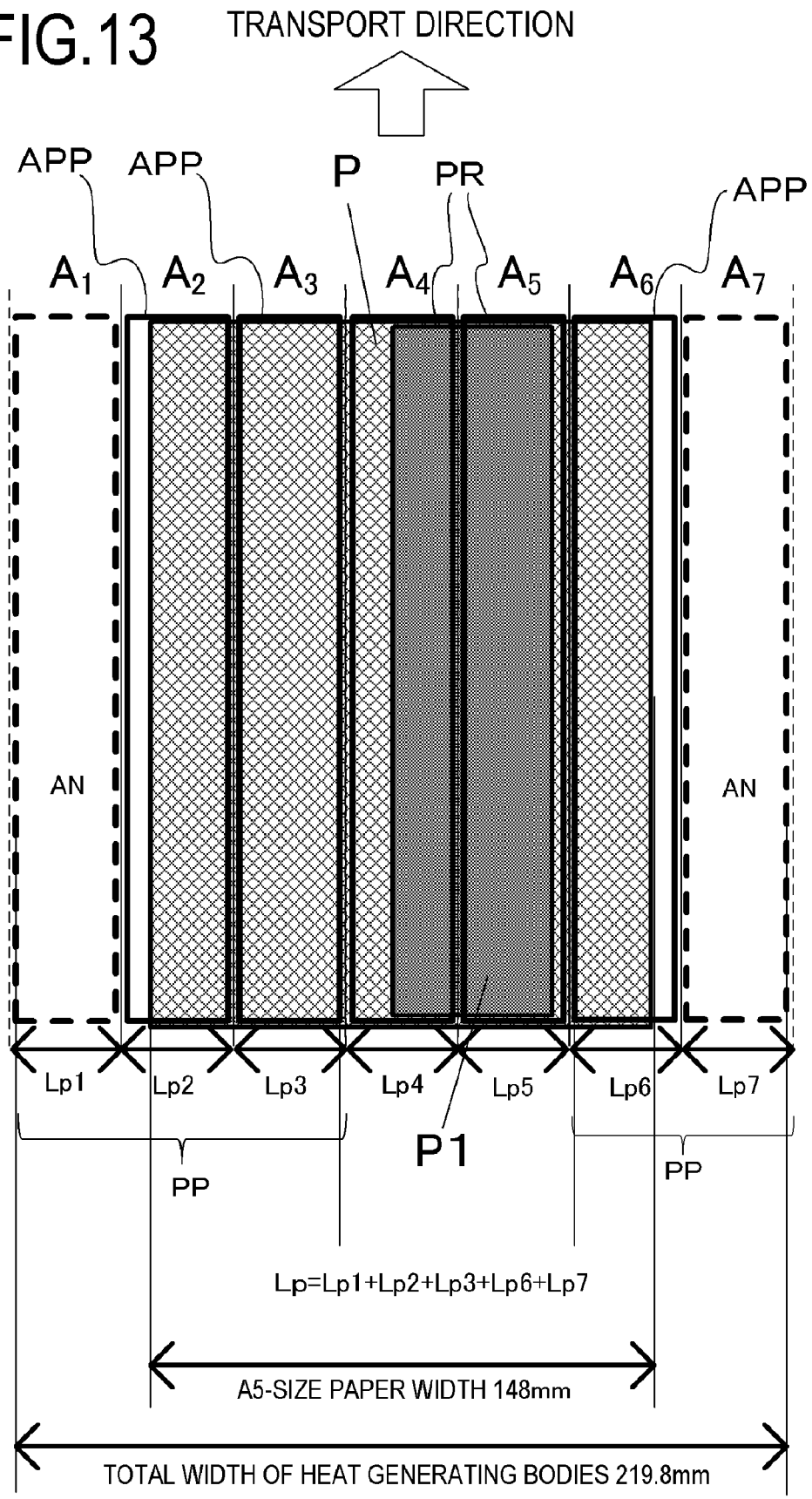
FIG. 13 is a diagram showing a recording material P, an image P1, and non-paper-passing heating portions AN according to Example 3.

FIG. 13 is a diagram showing a recording material P, an image P1, paper-passing non-image-heating portions APP with respect to the recording material P, and image heating portions PR with respect to the image P1 according to the present example. In the diagram, the recording material P represents a sheet of A5-size paper. The image P1 is formed so as to straddle the heated regions $A_4$ and $A_5$. The image heating portions PR are depicted by a bold frame overlapping the image P1 (a gray-tone portion) in the diagram. While the paper-passing non-image-heating portions APP according to the present example are sections where the recording material P is heated in each heated region, portions in which image data is not formed are heated. In other words, the paper-passing non-image-heating portions APP are heated regions which the recording material passes but an image formed on the recording material does not pass among the plurality of heated regions. The paper-passing non-image-heating portions APP are depicted by a bold frame only being overlapped with the recording material (a shaded portion) in the diagram. In addition, non-paper-passing heating portions AN are sections in which the recording material P is not heated in the respective heated regions and are depicted by a bold frame formed by dash lines. In the present example, the non-image-heating portions PP are sections combining the non-paper-passing heating portions AN and the paper-passing non-image-heating portions APP. Since the recording material P does not pass over entire regions of the heated regions $A_1$ and $A_7$, the entire regions are non-paper-passing heating portions AN. Since the recording material P passes over entire regions of the heated regions $A_2$, $A_3$, and $A_6$, the entire regions are paper-passing non-image-heating portions APP. Entire regions of the heated regions $A_4$ and $A_5$ constitute the image heating portions PR.

In the present example, a target temperature $T_0$ of the image heating portions PR is set to 180° C. in an ordinary paper mode.

In the present example, the target temperature of the non-image-heating portions PP is divided into the target temperature $T_{AP}$ of the paper-passing non-image-heating portions APP and the target temperature $T_{AN}$ of the non-paper-passing heating portions AN. The target temperature $T_{AP}$ and the target temperature $T_{AN}$ are set in accordance with the total length Lp of the non-image-heating portions PP passing the fixing nip portion N.

Figure 14:
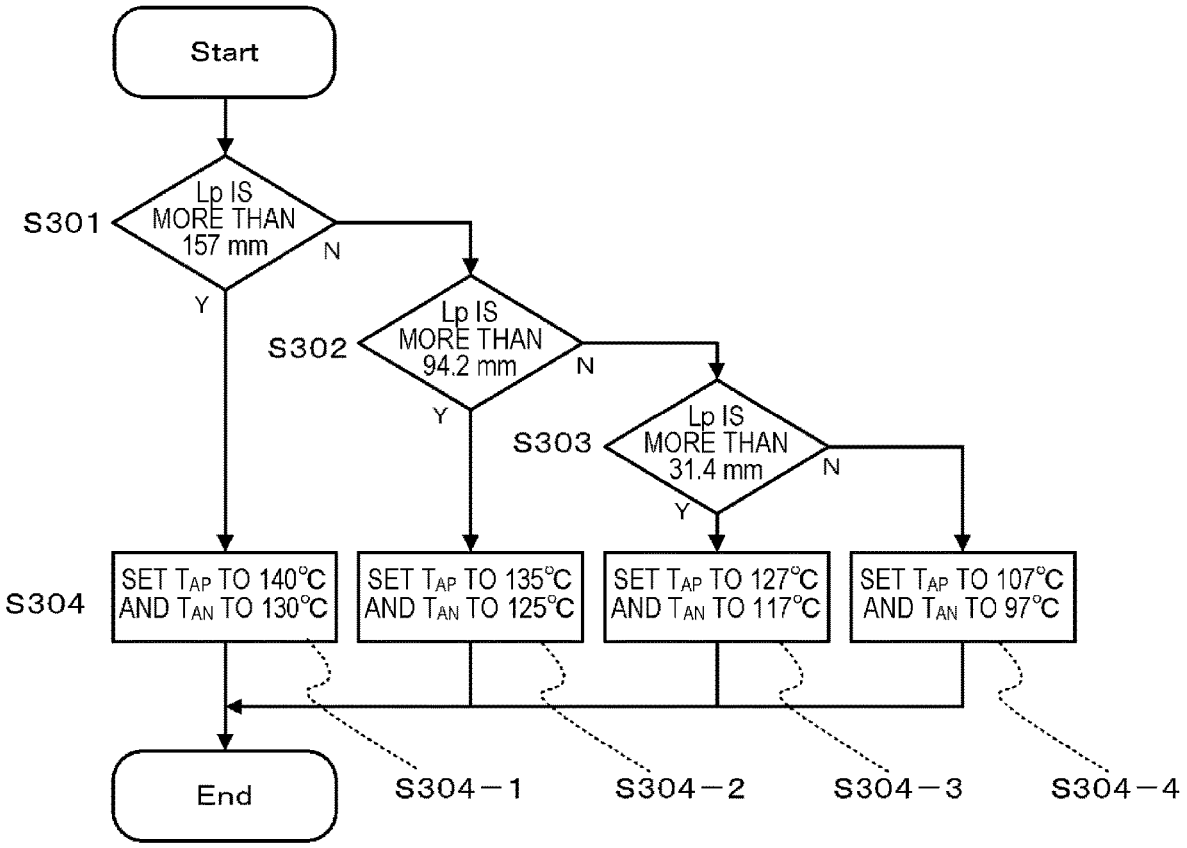
FIG. 14 is a flow chart showing a target temperature determination sequence according to Example 3.

FIG. 14 shows a determination sequence of the target temperatures $T_{AP}$ and $T_{AN}$ according to the present example. The target temperature $T_{AP}$ and the target temperature $T_{AN}$ are determined as follows in accordance with the total length Lp of the non-image-heating portions PP. When the total length Lp is more than 157 mm, the target temperature $T_{AP}$ is set to 140° C. and the target temperature $T_{AN}$ is set to 130° C. (S301, S304-1). When the total length Lp is more than 94.2 mm and 157 mm or less, the target temperature $T_{AP}$ is set to 135° C. and the target temperature $T_{AN}$ is set to 125° C. (S302, S304-2). When the total length Lp is more than 31.4 mm and 94.2 mm or less, the target temperature $T_{AP}$ is set to 127° C. and the target temperature $T_{AN}$ is set to 117° C. (S303, S304-3). When the total length Lp is 31.4 mm or less, the target temperature $T_{AP}$ is set to 107° C. and the target temperature $T_{AN}$ is set to 97° C. (S304-4).

Comparative Example 3 in which the target temperature $T_{AP}$ is set to 140° C. and the target temperature $T_{AN}$ is set to 130° C. regardless of the total length Lp of the non-image-heating portions PP will now be compared with the present example. Table 3 represents a table comparing the respective target temperatures $T_{AP}$ and $T_{AN}$ according to the present example and Comparative Example 3.

TABLE 3

| Total length Lp of non-image-heating portions PP | Target temperature $T_{AP}$ | | Target temperature $T_{AN}$ | |
|---|---|---|---|---|
| | Example 3 | Comparative Example 3 | Example 3 | Comparative Example 3 |
| 157 mm < Lp | 140° C. | 140° C. | 130° C. | 130° C. |
| 94.2 mm < Lp ≤ 157 mm | 135° C. | | 125° C. | |
| 31.4 mm < Lp ≤ 94.2 mm | 127° C. | | 117° C. | |
| Lp ≤ 31.4 mm | 107° C. | | 97° C. | |

As shown in Table 3, under a condition expressed as Lp≤157 mm, the target temperature $T_{AP}$ and the target temperature $T_{AN}$ can be lowered in the present example as compared to Comparative Example 3 and power saving can be achieved.

Configurations of the respective examples described above can be mutually combined to the greatest extent feasible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-096655, filed May 18, 2018, and No. 2019-077218, filed Apr. 15, 2019, which are hereby incorporated by reference herein in their entirety.

What is claimed is:

1. An image heating apparatus for heating an image formed on a recording material, the image heating apparatus comprising:

a cylindrical film, wherein a lubricant is applied to an inner surface of the film;

a heater which is in contact with the inner surface of the film, the heater having a plurality of heat generating elements arranged in a longitudinal direction of the heater which is perpendicular to a transport direction of the recording material;

a roller which is in contact with an outer surface of the film and which forms a nip portion that sandwiches the recording material together with the film and that transports the recording material; and a control portion capable of individually controlling power supplied to the plurality of heat generating elements, wherein the apparatus heats an image formed on the recording material by heat of the heater while sandwiching and transporting the recording material using the nip portion, wherein the control portion supplies power to the plurality of heat generating elements so that regions without an image on the recording material are also heated during a period in which the recording material is heated in the nip portion, and wherein the control portion sets a target temperature of the heat generating elements corresponding to the regions without an image when the recording material passes the nip portion in accordance with a length of the regions without an image in the longitudinal direction of the heater, and wherein the control portion sets the target temperature to be higher as the length of the regions without an image in the longitudinal direction of the heater when the recording material passes the nip portion increases.

2. The image heating apparatus according to claim 1, wherein the control portion sets the target temperature to be lower as the length of the regions without an image in the longitudinal direction of the heater decreases.

3. The image heating apparatus according to claim 1, wherein the control portion sets the target temperature of a region, among the regions without an image in the longitudinal direction, adjacent to a region with an image to be higher than the target temperature of a region apart from the region with the image.

4. The image heating apparatus according to claim 3, wherein the control portion sets the target temperature of a region apart from the region with an image to be lower as a length of the regions without an image decreases.

5. The image heating apparatus according to claim 3, wherein the control portion sets an average temperature of the target temperatures of a plurality of the regions without an image to be lower as a length of the regions without an image decreases.

6. The image heating apparatus according to claim 1, wherein the control portion sets the target temperature of the heat generating elements corresponding to the regions without an image to be lower as a proportion of regions with an image in the longitudinal direction of the heater increases.

7. An image heating apparatus for heating an image formed on a recording material, the image heating apparatus comprising:

a cylindrical film, wherein a lubricant is applied to an inner surface of the film;

a heater which is in contact with the inner surface of the film, the heater having a plurality of heat generating elements arranged in a longitudinal direction of the heater which is perpendicular to a transport direction of the recording material;

a roller which is in contact with an outer surface of the film and which forms a nip portion that sandwiches the recording material together with the film and that transports the recording material; and a control portion capable of individually controlling power to be supplied to the plurality of heat generating elements, wherein the apparatus heats an image formed on the recording material by heat of the heater while sandwiching and transporting the recording material using the nip portion, wherein the control portion supplies power to the plurality of heat generating elements so that regions where the recording material does not pass are also heated during a period in which the recording material is heated, and wherein the control portions sets a target temperature of the heat generating elements corresponding to the regions where the recording material does not pass when the recording material passes the nip portion in accordance with a length of the regions where the recording material does not pass in the longitudinal direction of the heater, and wherein the control portion sets the target temperature to be higher as the length of the regions where the recording material does not pass in the longitudinal direction of the heater when the recording material passes the nip portion increases.

8. The image heating apparatus according to claim 7, wherein the control portion sets the target temperature to be lower as the length decreases.

* * * * *